US011994148B2

(12) United States Patent
Hayashi et al.

(10) Patent No.: US 11,994,148 B2
(45) Date of Patent: May 28, 2024

(54) CENTRIFUGAL FAN, AIR-SENDING DEVICE, AIR-CONDITIONING APPARATUS, AND REFRIGERATION CYCLE APPARATUS

(71) Applicant: Mitsubishi Electric Corporation, Tokyo (JP)

(72) Inventors: Hiroyasu Hayashi, Tokyo (JP); Takuya Teramoto, Tokyo (JP); Kazuya Michikami, Tokyo (JP); Ryo Horie, Tokyo (JP); Takahiro Yamatani, Tokyo (JP); Hiroshi Tsutsumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 535 days.

(21) Appl. No.: 17/287,826

(22) PCT Filed: Dec. 19, 2018

(86) PCT No.: PCT/JP2018/046779
§ 371 (c)(1),
(2) Date: Apr. 22, 2021

(87) PCT Pub. No.: WO2020/129179
PCT Pub. Date: Jun. 25, 2020

(65) Prior Publication Data

US 2021/0388847 A1 Dec. 16, 2021

(51) Int. Cl.
*F04D 29/42* (2006.01)
*F24F 7/007* (2006.01)

(52) U.S. Cl.
CPC ..... *F04D 29/4226* (2013.01); *F24F 7/007* (2013.01)

(58) Field of Classification Search
CPC .. F04D 29/4226; F04D 29/424; F04D 29/441; F04D 29/663; F24F 7/007;
(Continued)

(56) References Cited

U.S. PATENT DOCUMENTS

2004/0253092 A1 12/2004 Hancock
2013/0243585 A1 9/2013 Sinzaki et al.
(Continued)

FOREIGN PATENT DOCUMENTS

CN 103228929 A 7/2013
EP 2 128 451 A1 12/2009
(Continued)

OTHER PUBLICATIONS

Pdf is translation of foreign reference JP 09242697 A (Year: 1997).*
(Continued)

*Primary Examiner* — Len Tran
*Assistant Examiner* — Kamran Tavakoldavani
(74) *Attorney, Agent, or Firm* — POSZ LAW GROUP, PLC

(57) ABSTRACT

A centrifugal fan includes a fan configured to be driven to rotate, and a scroll casing housing the fan. The scroll casing includes a peripheral wall having a volute shape having an inner end of a spiral thereof at a boundary with a tongue portion of the scroll casing. When a portion at the peripheral wall at which a distance between the peripheral wall and a rotation shaft of the fan is minimum is defined as a closest portion, the peripheral wall includes a narrowed portion at which the distance between the peripheral wall and the rotation shaft is reduced from the inner end toward the closest portion in a rotation direction of the fan, and an expanded portion that is formed between the narrowed portion and the closest portion and at which the distance between the peripheral wall and the rotation shaft is increased.

19 Claims, 14 Drawing Sheets

(58) Field of Classification Search
CPC ..... F24F 1/0018; F24F 1/0022; F24F 1/028; F24F 2013/205; F25D 17/067
See application file for complete search history.

(56) References Cited

U.S. PATENT DOCUMENTS

| | | | | |
|---|---|---|---|---|
| 2016/0047580 | A1* | 2/2016 | Cho | F28F 9/027 62/529 |
| 2016/0108928 | A1* | 4/2016 | Son | F24F 1/0033 415/205 |

FOREIGN PATENT DOCUMENTS

| | | | | |
|---|---|---|---|---|
| EP | 2128451 | A1 | | 12/2009 |
| GB | 2551281 | A | | 12/2017 |
| JP | 09-242697 | A | | 9/1997 |
| JP | 09242697 | A | * | 9/1997 |
| JP | 2005036679 | A | | 2/2005 |
| JP | 2008-240612 | A | | 10/2008 |
| JP | 2011-149328 | A | | 8/2011 |
| JP | 2016-033338 | A | | 3/2016 |
| TW | 200916663 | A | | 4/2009 |
| WO | 2016/139732 | A1 | | 9/2016 |

OTHER PUBLICATIONS

Examination Report dated Aug. 31, 2021, issued in corresponding IN Patent Application No. 202127025933 (and English Machine Translation).

Office Action dated May 4, 2020, issued in corresponding Taiwanese Patent Application 108126504 (and English translation).

Office Action dated Oct. 14, 2020, issued in corresponding Taiwanese Patent Application 108126504 (and English translation).

International Search Report dated Mar. 12, 2019, issued in corresponding International Application PCT/JP2018/046779 (and English translation).

* cited by examiner

CENTRIFUGAL FAN, AIR-SENDING DEVICE, AIR-CONDITIONING APPARATUS, AND REFRIGERATION CYCLE APPARATUS

CROSS REFERENCE TO RELATED APPLICATION

This application is a U.S. National Stage Application of International Application No. PCT/JP2018/046779, filed on Dec. 19, 2018, the contents of which are incorporated herein by reference.

TECHNICAL FIELD

The present disclosure relates to a centrifugal fan including a scroll casing; and an air-sending device, an air-conditioning apparatus, and a refrigeration cycle apparatus including the centrifugal fan.

BACKGROUND

A conventional centrifugal fan includes a fan including a main plate on a disk and a plurality of blades in a scroll casing, and a tongue portion required for blowing out, in the centrifugal direction, the air that has entered from an air inlet formed at an end of the fan in the rotation axis direction, and increasing the pressure thereof. In the centrifugal fan, when the airflow in the scroll casing that has entered from the air inlet moves toward an air outlet, part of the airflow branches off at the tongue portion and enters the scroll again. Here, a gas passage formed between the tongue portion and the blades suddenly narrows, so that a large pressure difference is generated between the airflow moving toward the air outlet and the airflow entering the scroll again. This causes an increase in noise level. In view of the above, there has been proposed a centrifugal fan in which the position where the clearance between a scroll casing and an outer periphery of a fan is minimum is shifted from a tongue portion in the blade rotation direction (see Patent Literature 1). In a centrifugal fan of Patent Literature 1, the position where the clearance between a scroll casing and an outer periphery of a fan is minimum is shifted from a tongue portion in the blade rotation direction, thereby reducing a sudden pressure difference in the tongue portion, and reducing the noise level.

PATENT LITERATURE

Patent Literature 1: Japanese Unexamined Patent Application Publication No. 09-242697

However, in the centrifugal fan of Patent Literature 1, since the position where the clearance between the scroll casing and the outer periphery of the fan is minimum is shifted from the tongue portion in the blade rotation direction, the volume of gas flowing through a flow passage from the tongue portion to this position is reduced. Therefore, the centrifugal fan of Patent Literature 1 may not be able to efficiently increase the pressure in a scroll portion formed in a volute shape.

SUMMARY

The present disclosure has been made to solve the above problem, and an object thereof is to provide a centrifugal fan, an air-sending device, an air-conditioning apparatus, and a refrigeration cycle apparatus that are capable of efficiently increasing the pressure in a scroll portion even in the case where the position where the clearance between a scroll casing and an outer periphery of a fan is minimum is shifted from a tongue portion in the blade rotation direction.

A centrifugal fan according to an embodiment of the present disclosure includes a fan configured to be driven to rotate; and a scroll casing housing the fan; the scroll casing including a peripheral wall having a volute shape having an inner end of a spiral thereof at a boundary with a tongue portion of the scroll casing, the tongue portion being configured to guide airflow generated by the fan, the peripheral wall including, when a portion at the peripheral wall at which a distance between the peripheral wall and a rotation shaft of the fan is minimum is defined as a closest portion, a narrowed portion at which the distance between the peripheral wall and the rotation shaft is reduced from the inner end toward the closest portion in a rotation direction of the fan, and an expanded portion that is formed between the narrowed portion and the closest portion and at which the distance between the peripheral wall and the rotation shaft is increased.

The centrifugal fan according to the above embodiment of the present disclosure includes the narrowed portion at which the distance between the peripheral wall and the rotation shaft is reduced from the inner end toward the closest portion in the rotation direction of the fan, and the expanded portion that is formed between the narrowed portion and the closest portion and at which the distance between the peripheral wall and the rotation shaft is increased. Therefore, in the centrifugal fan, the distance between the peripheral wall and the outer peripheral portion of the fan is gradually reduced from the tongue portion toward the closest portion, and then the distance between the peripheral wall and the outer peripheral portion of the fan is increased in front of the closest portion. In the centrifugal fan, since the distance between the peripheral wall and the outer peripheral portion of the fan is increased in front of the closest portion, the air volume is secured. Further, as the gas of the secured volume passes through the closest portion, the velocity of the gas is increased. Accordingly, the centrifugal fan can effectively increase the pressure in the scroll portion.

DETAILED DESCRIPTION

Figure 1:
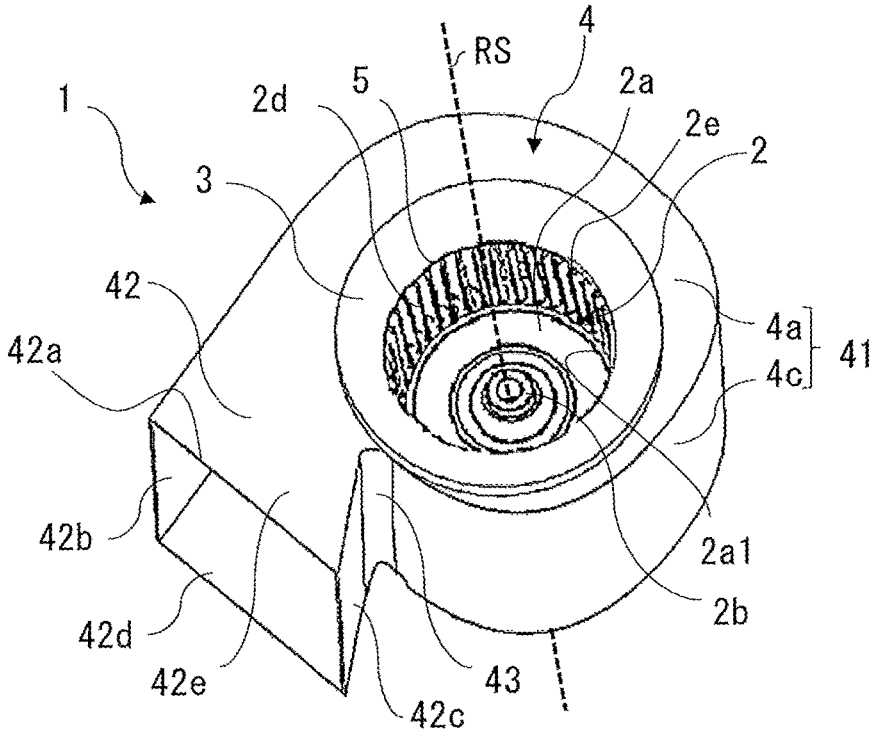
FIG. 1 is a perspective view of a centrifugal fan according to Embodiment 1 of the present disclosure.

Hereinafter, centrifugal fans 1, 1A, 1B, 1C, 1D, 1E, 1F, and 1G according to Embodiments of the present disclosure will be described with reference to the drawings. An air-sending device 30, an air-conditioning apparatus 40, and a refrigeration cycle apparatus 50 according to Embodiments of the present disclosure will also be described with reference to the drawings. Note that in the drawings including FIG. 1 to be referred to below, the relative dimensional relationship between the components, the shape, and other features thereof may differ from the actual ones. Further, in the drawings to be referred to below, identical reference numerals designate identical or equivalent components, and this applies throughout the description. Terms indicating directions (such as "up", "down", "right", "left", "front", and "rear") are used as appropriate, for facilitating understanding. However, these expressions are described as such for purposes of explanation, and the arrangement and the orientations of the devices or the parts are not limited thereby.

Embodiment 1

Figure 2:
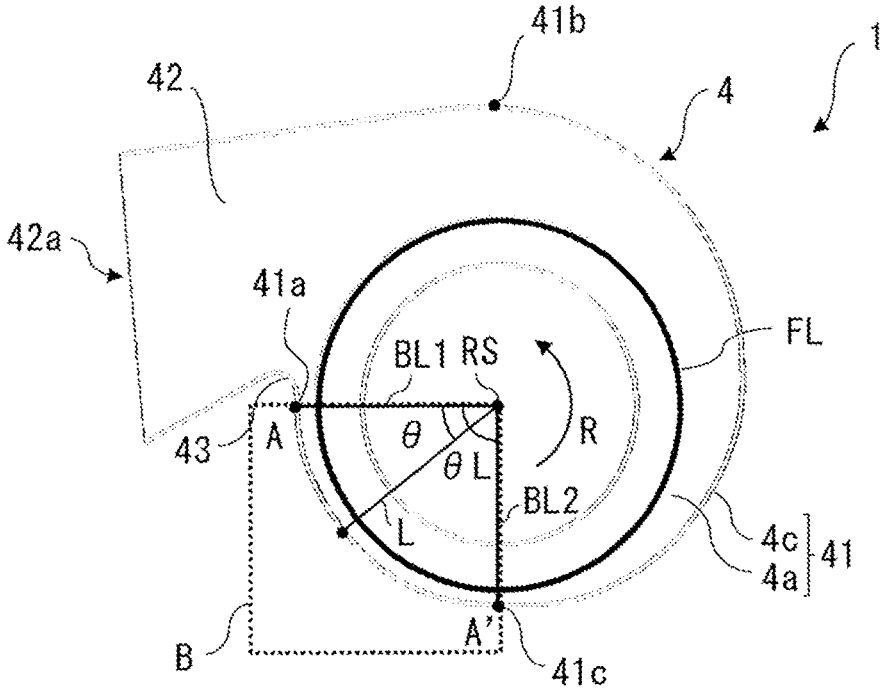
FIG. 2 is a schematic diagram of the centrifugal fan according to Embodiment 1 of the present disclosure as viewed from an air inlet side thereof.

FIG. 1 is a perspective view of the centrifugal fan 1 according to Embodiment 1 of the present disclosure. FIG. 2 is a schematic diagram of the centrifugal fan 1 according to Embodiment 1 of the present disclosure as viewed from an air inlet 5 side thereof. Note that FIG. 2 is a schematic diagram illustrating a cross-section of the center portion of a scroll casing 4 in the axial direction of a below-described rotation shaft RS. In the following, a description will be given with reference to the cross-section of the center portion of the scroll casing 4 in the axial direction of the rotation shaft RS. However, a cross-section of another portion of the scroll casing 4 may be referred to. The configuration of the centrifugal fan 1 described below only needs to be present at least a part thereof in the axial direction of the rotation shaft RS, and may be present in the entire region thereof in the axial direction of the rotation shaft RS. A basic structure of the centrifugal fan 1 will be described with reference to FIGS. 1 and 2. The centrifugal fan 1 is a multi-blade centrifugal-type centrifugal fan 1 such as a sirocco fan or a turbofan, and includes a fan 2 configured to generate airflow, and the scroll casing 4 housing the fan 2.

The fan 2 is configured to be driven by a motor or other devices (not illustrated) to rotate, and forcibly send air radially outward by a centrifugal force generated by the rotation. As illustrated in FIG. 1, the fan 2 includes a disk-shaped main plate 2*a* and a plurality of blades 2*d* disposed at a peripheral edge portion 2*a*1 of the main plate 2*a*. The main plate 2*a* only needs to have a plate shape, and may have a shape (such as a polygonal shape) other than a disk shape. A shaft portion 2*b* to which the motor (not illustrated) is connected is disposed at the center of the main plate 2*a*. The fan 2 is formed in a cylindrical shape by the main plate 2*a* and the plurality of blades 2*d*, and has air inlets 2*e*, one at each end opposite to the main plate 2*a* in the axial direction of the rotation shaft RS of the fan 2. The air inlets 2*e* allow gas to enter the space surrounded by the main plate 2*a* and the plurality of blades 2*d*.

The plurality of blades 2*d* are arranged circumferentially about the shaft portion 2*b*, and proximal ends thereof are fixed to the main plate 2*a*. The plurality of blades 2*d* are disposed on both sides of the main plate 2*a* in the axial direction of the rotation shaft RS of the shaft portion 2*b*. Note that in the case of a single-inlet centrifugal fan 1 having only one air inlet 5, the plurality of blades 2*d* may be disposed on only one side of the main plate 2*a* in the axial direction of the rotation shaft RS of the shaft portion 2*b*. The blades 2*d* are spaced at regular intervals from each other at the peripheral edge portion 2*a*1 of the main plate 2*a*. Each blade 2*d* is formed in, for example, a curved rectangular plate shape, and is disposed in parallel to the radial direction or inclined at a predetermined angle with respect to the radial direction.

The fan 2 is driven to rotate about the rotation shaft RS when the motor (not illustrated) is driven. As the fan 2 rotates, gas outside the centrifugal fan 1 passes through the air inlets 5 formed in the scroll casing 4 and the air inlets 2*e* of the fan 2, and is suctioned into the space surrounded by the main plate 2*a* and the plurality of blades 2*d*. Then, as the fan 2 rotates, the air suctioned into the space surrounded by the main plate 2*a* and the plurality of blades 2*d* passes between the adjacent blades 2*d*, and is sent radially outward. Note that in Embodiment 1, each blade 2*d* is disposed upright to be substantially perpendicular to the main plate 2*a*. However, the configuration is not limited thereto. Each blade 2*d* may be inclined to the perpendicular direction of the main plate 2*a*.

The scroll casing 4 houses the fan 2, and straightens the air blown out from the fan 2. The scroll casing 4 includes a scroll portion 41 and an outlet portion 42.

The scroll portion 41 forms an air flow passage configured to convert a dynamic pressure of the airflow generated by the fan 2 to a static pressure. The scroll portion 41 includes side walls 4*a* each covering the fan 2 in the axial direction of the rotation shaft RS of the shaft portion 2*b* of the fan 2 and having the air inlet 5 configured to suction air, and a peripheral wall 4*c* surrounding the fan 2 in the radial direction of the rotation shaft RS of the shaft portion 2*b* of the fan 2. The scroll portion 41 further includes a tongue portion 43 disposed between the outlet portion 42 and an inner end 41*a* of the peripheral wall 4*c* to define a curved surface, and configured to guide the airflow generated by the fan 2 to an air outlet 42*a* via the scroll portion 41. Note that the radial direction of the rotation shaft RS is a direction perpendicular to the rotation shaft RS. An inner space in the scroll portion 41 defined by the peripheral wall 4*c* and the side walls 4*a* is a space in which the air blown out from the fan 2 flows along the peripheral wall 4*c*.

Each side wall 4*a* is disposed substantially perpendicular to the axial direction of the rotation shaft RS of the fan 2 to cover the fan 2. The air inlet 5 is formed in the side wall 4*a* of the scroll casing 4 to allow air to flow between the fan 2 and the outside of the scroll casing 4. The air inlet 5 is formed in a circular shape, and is disposed such that the center of the air inlet 5 substantially coincides with the center of the shaft portion 2*b* of the fan 2. With this configuration of the side wall 4*a*, the air in the vicinity of the air inlet 5 smoothly flows, and efficiently enters the fan 2 from the air inlet 5. The centrifugal fan 1 includes the scroll casing 4 of a double-inlet type that has the side walls 4*a* each having the air inlet 5, one on each side of the main plate 2*a* in the axial direction of the rotation shaft RS of the shaft portion 2*b*. That is, the centrifugal fan 1 includes the scroll casing 4 having two side walls 4*a*, and the side walls 4*a* are disposed to face each other. Note that the centrifugal fan 1 may include a scroll casing 4 of a single-inlet type that has the side wall 4*a* having the air inlet 5, only on one side of the main plate 2*a* in the axial direction of the rotation shaft RS of the shaft portion 2*b*. In this case, the scroll casing 4 of the centrifugal fan 1 has the side wall 4*a* having the air inlet 5, and a side wall (not illustrated) having no air inlet 5 and disposed to face the side wall 4*a*.

The air inlet 5 formed in the side wall 4*a* is defined by a bell mouth 3. The bell mouth 3 straightens the flow of gas to be suctioned into the fan 2 to guide the gas into the air inlet 2*e* of the fan 2. The bell mouth 3 is formed such that its opening diameter gradually decreases from the outer side toward the inner side of the scroll casing 4.

The peripheral wall 4*c* surrounds the fan 2 in the radial direction of the shaft portion 2*b* to define an inner peripheral surface facing the plurality of blades 2*d*. The peripheral wall 4*c* faces the air outlet side of the blades 2*d* of the fan 2. The peripheral wall 4*c* is disposed substantially parallel to the axial direction of the rotation shaft RS of the fan 2 to cover the fan 2. As illustrated in FIG. 2, the peripheral wall 4*c* extends from the inner end 41*a* located at the boundary with the tongue portion 43 to an outer end 41*b* located at the boundary between the outlet portion 42 and the scroll portion 41 on the side far from the tongue portion 43 in a rotation direction R of the fan 2. The inner end 41*a* corresponds to an end on the upstream side of the airflow generated by the rotation of the fan 2, and the outer end 41*b* corresponds to an end on the downstream side of the airflow generated by the rotation of the fan 2, at the peripheral wall 4*c* forming a curved surface.

The peripheral wall 4*c* has a width in the axial direction of the rotation shaft RS of the fan 2. The peripheral wall 4*c* is formed in a volute shape. The volute shape may be, for example, a volute shape based on a logarithm spiral, an Archimedean spiral, or an involute curve. The inner peripheral surface of the peripheral wall 4*c* forms a curved surface that is smoothly curved from the inner end 41*a* as a scroll start end of the volute shape to the outer end 41*b* as a scroll terminal end of the volute shape in the circumferential direction of the fan 2. With this configuration, the air sent from the fan 2 smoothly flows through the clearance between the fan 2 and the peripheral wall 4*c* toward the outlet portion 42. Therefore, in the scroll casing 4, the static pressure of air is effectively increased from the tongue portion 43 toward the outlet portion 42. The configuration of the peripheral wall 4*c* will be described below in detail.

The outlet portion 42 defines the air outlet 42*a* through which the airflow generated by the fan 2 and having passed through the scroll portion 41 is discharged. The outlet portion 42 is formed of a hollow pipe having a rectangular shape in a cross-section orthogonal to the direction of the airflow flowing along the peripheral wall 4*c*. As illustrated in FIGS. 1 and 2, the outlet portion 42 defines a flow passage that guides the air sent from the fan 2 and flowing though the clearance between the peripheral wall 4*c* and the fan 2 to discharge the air to the outside of the scroll casing 4.

As illustrated in FIG. 1, the outlet portion 42 includes an extension plate 42*b*, a diffuser plate 42*c*, a first side plate 42*d*, and a second side plate 42*e*. The extension plate 42*b* smoothly continues to the outer end 41*b* on the downstream side of the peripheral wall 4*c*, and is formed integrally with the peripheral wall 4*c*. The diffuser plate 42*c* is formed integrally with the tongue portion 43 of the scroll casing 4, and faces the extension plate 42*b*. The diffuser plate 42*c* is formed at a predetermined angle with respect to the extension plate 42*b* such that the cross-sectional area of the flow passage gradually increases in the direction of the airflow in the outlet portion 42. The first side plate 42*d* is formed integrally with the side wall 4*a* of the scroll casing 4, and the second side plate 42*e* is formed integrally with the side wall 4*a* on the opposite side of the scroll casing 4. The first side plate 42*d* and the second side plate 42*e* are formed between the extension plate 42*b* and the diffuser plate 42*c*. In this manner, the outlet portion 42 has a flow passage with a rectangular cross-sectional shape defined by the extension plate 42*b*, the diffuser plate 42*c*, the first side plate 42*d*, and the second side plate 42*e*.

The tongue portion 43 is formed between the diffuser plate 42*c* of the outlet portion 42 and the inner end 41*a* of the peripheral wall 4*c* in the scroll casing 4. The tongue portion 43 minimizes the air flowing from the scroll terminal end to the scroll start end of the volute-shaped flow passage. The tongue portion 43 is disposed on the upstream side of the air flow passage, and serves to separate between an airflow flowing in the rotation direction R of the fan 2 and an airflow flowing from the downstream of the air flow passage to the air outlet 42*a*. The tongue portion 43 is disposed at the boundary portion between the scroll portion 41 and the outlet portion 42, and is a protrusion expanding toward the inner side of the scroll casing 4. The tongue portion 43 extends in a direction parallel to the axial direction of the rotation shaft RS of the shaft portion 2*b* in the scroll casing 4. The tongue portion 43 is disposed between the end of the outlet portion 42 and the inner end 41*a* of the peripheral wall 4*c* to define a curved surface, and configured to guide the airflow generated by the fan 2 to the air outlet 42*a* via the scroll portion 41.

The tongue portion 43 is formed to have a predetermined curvature radius, and the peripheral wall 4*c* is smoothly connected to the diffuser plate 42*c* via the tongue portion 43. When the air having passed through the fan 2 from the air inlet 5 and sent out therefrom is collected by the scroll casing 4 and enters the outlet portion 42, the tongue portion 43 serves as a branching point of the flow passage of the air. That is, at the inlet port of the outlet portion 42, an airflow moving toward the air outlet 42*a* and an airflow flowing again to the upstream side from the tongue portion 43. Further, when the airflow passes through the scroll casing 4, its static pressure increases. Therefore, the airflow entering the outlet portion 42 has a pressure higher than the pressure in the scroll casing 4. Accordingly, the tongue portion 43 has a function for separating such different pressures, and guiding the air that is to enter the outlet portion 42 to each flow passage.

Figure 3:
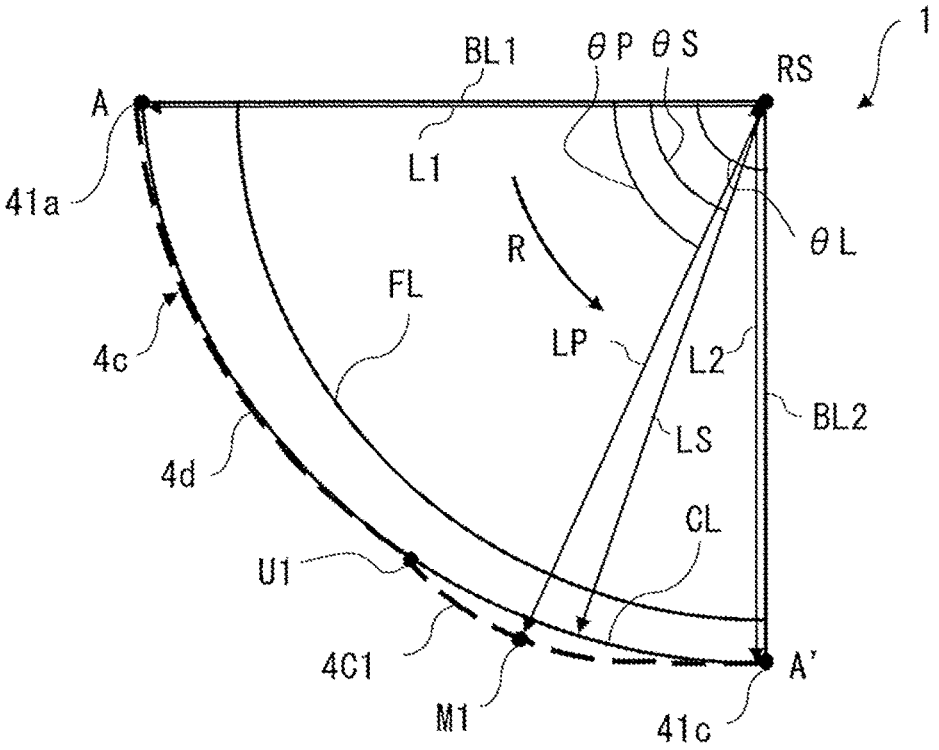
FIG. 3 is an enlarged view of a part B of the centrifugal fan of FIG. 2.

FIG. 3 is an enlarged view of a part B of the centrifugal fan 1 of FIG. 2. Note that in FIG. 3, the peripheral wall 4*c* of the centrifugal fan 1 of Embodiment 1 is indicated by the long-dashed line for comparison with a below-described reference peripheral wall CL. The structure of the centrifugal fan 1 of Embodiment 1 will be described with reference to FIGS. 2 and 3.

An outer peripheral portion FL illustrated in FIGS. 2 and 3 is an outer peripheral portion of the fan 2. The outer peripheral portion FL is in the position of the edges of the blades 2*d* located at the outermost periphery of the fan 2 in plan view as viewed in the axial direction of the rotation shaft RS of the centrifugal fan 1. The distance between the outer peripheral portion FL and the rotation shaft RS is constant throughout. Note that the edges of the blades 2*d* refer to the radially outer edge of the fan 2.

The reference peripheral wall CL illustrated in FIG. 3 represents a peripheral wall of a centrifugal fan of a comparative example. The reference peripheral wall CL is a virtual peripheral wall configured such that the peripheral wall 4*c* approaches the rotation shaft RS at a constant rate from the inner end 41*a* toward a below-described closest portion 41*c*.

The closest portion 41*c* is a portion that is located between the inner end 41*a* and the outer end 41*b* of the reference peripheral wall CL and at which the distance between the reference peripheral wall CL and the rotation shaft RS is minimum. In other words, the closest portion 41*c* is a portion that is located between the inner end 41*a* and the outer end 41*b* of the reference peripheral wall CL and at which the distance between the reference peripheral wall CL and the outer peripheral portion FL of the fan 2 is minimum. A portion that is located between the inner end 41*a* and the outer end 41*b* of the peripheral wall 4*c* and at which the distance between the peripheral wall 4*c* of the scroll casing 4 and the rotation shaft RS is minimum is also defined as the closest portion 41*c*. In other words, the closest portion 41*c* is a portion that is located between the inner end 41*a* and the outer end 41*b* of the peripheral wall 4*c* and at which the distance between the peripheral wall 4*c* of the scroll casing 4 and the outer peripheral portion FL of the fan 2 is minimum.

The centrifugal fan of the comparative example has a structure in which the closest portion 41*c* is shifted from the tongue portion 43 in the rotation direction R of the fan 2. The centrifugal fan 1 according to Embodiment 1 also has a structure in which the closest portion 41*c* is shifted from the tongue portion 43 in the rotation direction R of the fan 2. Note that although the closest portion 41*c* is formed in the position rotated by about 90 degrees from the inner end 41*a* in the circumferential direction of the rotation shaft RS in FIGS. 2 and 3, the position where the closest portion 41*c* is formed is not limited to the position rotated by about 90 degrees from the inner end 41*a*. The closest portion 41*c* only needs to be formed in a position between the inner end 41*a* and the outer end 41*b*. For example, the closest portion 41*c* may be formed in the position rotated by about 180 degrees from the inner end 41*a*. It is particularly preferable that the closest portion 41*c* is formed near an air inlet of, for example, an indoor unit in which the centrifugal fan 1 is disposed. Note that the relationship between the closest portion 41*c* and an air inlet of an air-conditioning apparatus will be described below.

A first reference line BL1 is a virtual line connecting the rotation shaft RS to the inner end 41*a* in a cross-section perpendicular to the rotation shaft RS. A second reference line BL2 is a virtual line connecting the rotation shaft RS to the closest portion 41*c* in the cross-section perpendicular to the rotation shaft RS.

A distance L illustrated in FIG. 2 represents the distance between the rotation shaft RS and the peripheral wall 4*c* or the reference peripheral wall CL. A distance LP illustrated in FIG. 3 represents the distance between the rotation shaft RS and the peripheral wall 4*c* in the direction perpendicular to the rotation shaft RS. A distance LS represents the distance between the rotation shaft RS and the reference peripheral wall CL.

A distance L1 represents the distance between the rotation shaft RS and the inner end 41*a* of the peripheral wall of the centrifugal fan of the comparative example in the direction perpendicular to the rotation shaft RS. In other words, the distance L1 represents the length of the first reference line BL1. The distance L1 also represents the distance between the rotation shaft RS and the inner end 41*a* of the peripheral wall 4*c* in the direction perpendicular to the rotation shaft RS. That is, the inner ends 41*a* of the centrifugal fan of the comparative example and the centrifugal fan 1 according to Embodiment 1 are located in the same position in the circumferential direction and the radial direction of the fan 2.

A distance L2 represents the distance between the rotation shaft RS and the closest portion 41*c* of the peripheral wall of the centrifugal fan of the comparative example in the direction perpendicular to the rotation shaft RS. In other words, the distance L2 represents the length of the second reference line BL2. The distance L2 also represents the distance between the rotation shaft RS and the closest portion 41*c* of the peripheral wall 4*c* in the direction perpendicular to the rotation shaft RS. That is, the closest portions 41*c* of the centrifugal fan of the comparative example and the centrifugal fan 1 according to Embodiment 1 are located in the same position in the circumferential direction and the radial direction of the fan 2.

An angle θ illustrated in FIG. 2 is an angle rotated from the first reference line BL1 in the rotation direction R of the fan 2, in a region between the first reference line BL1 connecting the rotation shaft RS to the inner end 41*a* and the second reference line BL2 connecting the rotation shaft RS to the closest portion 41*c*, in a cross-section perpendicular to the rotation shaft RS. An angle θP illustrated in FIG. 3 is an angle in the circumferential direction rotated from the inner end 41*a* to a measurement position of the distance LP about the rotation shaft RS, in plan view as viewed in the axial direction of the rotation shaft RS of the centrifugal fan 1. An angle θS is an angle in the circumferential direction rotated from the inner end 41*a* to a measurement position of the distance LS about the rotation shaft RS, in plan view as viewed in the axial direction of the rotation shaft RS of the centrifugal fan of the comparative example.

An angle θL is an angle in the circumferential direction rotated from the inner end 41*a* to the position of the closest portion 41*c* about the rotation shaft RS, in plan view as viewed in the axial direction of the rotation shaft RS of the centrifugal fan 1. Note that although the angle θL is set to about 90 degrees in FIGS. 2 and 3, the angle θL is not limited to about 90 degrees. The angle θL may be any angle between the inner end 41*a* to the outer end 41*b*. For example, the angle θL may be about 180 degrees.

Figure 4:
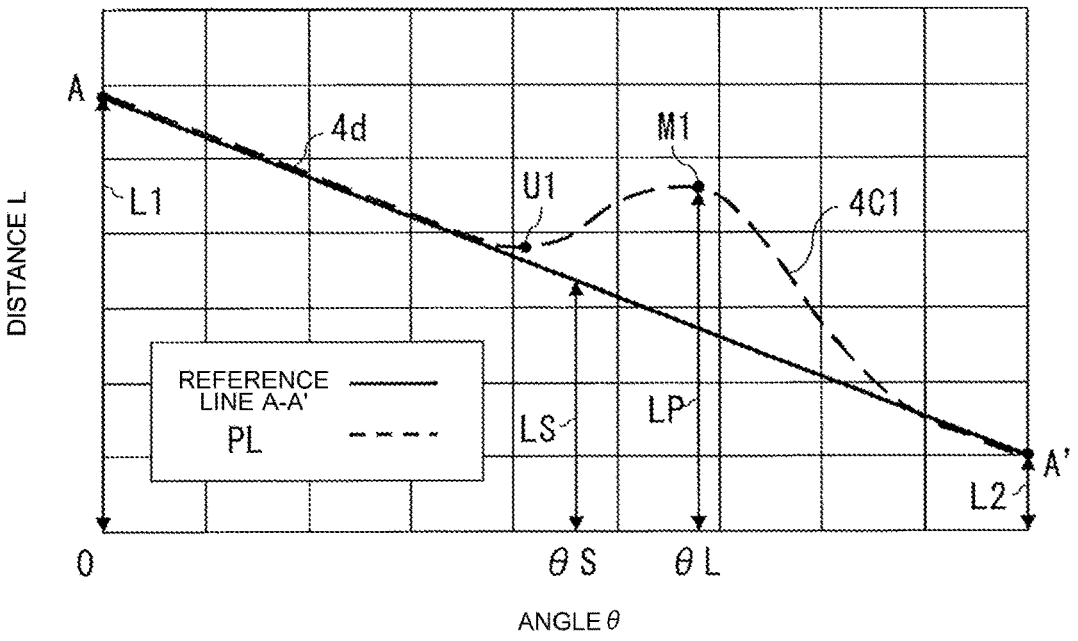
FIG. 4 is a graph illustrating a relationship between an angle θ and a distance L in each of the centrifugal fan of FIG. 3 and a centrifugal fan of a comparative example.

FIG. 4 is a graph illustrating a relationship between the angle θ and the distance L in each of the centrifugal fan 1 of FIG. 3 and the centrifugal fan of the comparative example. The structure of the centrifugal fan 1 will be described in greater detail with reference to FIGS. 3 and 4.

A reference line A-A' illustrated in FIG. 4 represents a relationship between the angle θ of the reference peripheral wall CL and the distance LS in the region from the inner end 41*a* to the closest portion 41*c*. As illustrated in FIG. 4, the reference peripheral wall CL is formed such that the distance LS decreases at a constant rate as the angle θ increases from the inner end 41*a* toward the closest portion 41*c*. Accordingly, the centrifugal fan of the comparative example is formed such that the reference peripheral wall CL approaches the rotation shaft RS at a predetermined rate from the inner end 41*a* toward the closest portion 41*c*. That is, the centrifugal fan of the comparative example is formed such that a gas flow passage narrows at a constant rate from the inner end 41*a* toward the closest portion 41*c*.

A curved line PL indicated by the long-dashed line in FIG. 4 represents a relationship between the angle θP of the peripheral wall 4*c* and the distance LP in the region from the inner end 41*a* to the closest portion 41*c*. As illustrated in FIGS. 3 and 4, the peripheral wall 4*c* includes an expanded portion 4*c*1 between the inner end 41*a* and the closest portion 41*c*. As illustrated in FIGS. 3 and 4, the expanded portion 4*c*1 is a portion of the peripheral wall 4*c* at which the distance LP between the rotation shaft RS and the peripheral wall 4*c* is greater than or equal to the distance LS between the rotation shaft RS and the reference peripheral wall CL. Compared to the virtual reference peripheral wall CL configured such that the peripheral wall 4*c* approaches the rotation shaft RS at a constant rate from the inner end 41*a* toward the closest portion 41*c*, the expanded portion 4*c*1 is formed such that a part of the peripheral wall 4*c* expands in the radial direction of the fan 2. The expanded portion 4*c*1 is a portion that is located on the inner end 41*a* side of the closest portion 41*c* and at which the distance between the peripheral wall 4*c* and the rotation shaft RS is increased. In other words, the expanded portion 4*c*1 is a portion that is located on the inner end 41*a* side of the closest portion 41*c* and at which the distance between the peripheral wall 4*c* and the outer peripheral portion FL of the fan 2 is increased. Note that as illustrated in FIG. 4, the distance between the peripheral wall 4*c* and the rotation shaft RS at the expanded portion 4*c*1 is less than the distance between the peripheral wall 4*c* and the rotation shaft RS at the inner end 41*a*.

Note that as illustrated in FIG. 4, the peripheral wall 4*c* includes a narrowed portion 4*d* at which the distance between the peripheral wall 4*c* and the rotation shaft RS decreases from the inner end 41*a* toward the closest portion 41*c* in the rotation direction R of the fan 2. The narrowed portion 4*d* is a portion of the peripheral wall 4*c* at which the distance between the peripheral wall 4*c* and the outer peripheral portion FL of the fan 2 decreases from the inner end 41*a* toward the closest portion 41*c* in the rotation direction R of the fan 2. The narrowed portion 4*d* is formed to extend from the inner end 41*a* to the expanded portion 4*c*1 in the rotation direction R of the fan 2 such that the distance LP decreases at a constant rate as the angle θ increases from the inner end 41*a* toward the closest portion 41*c*. Note that the rate at which the distance LP decreases as the angle θ increases is equal to the rate at which the distance LS decreases as the angle θ increases. That is, the peripheral wall 4*c* from the inner end 41*a* to the expanded portion 4*c*1 is formed such that the curved line PL has the same inclination as the reference line A-A'.

As illustrated in FIGS. 3 and 4, the peripheral wall 4*c* includes a first inflection portion U1 and a second inflection portion M1 at the expanded portion 4*c*1. As illustrated in FIG. 4, the first inflection portion U1 is a minimum point of the curved line PL at the expanded portion 4*c*1, and the second inflection portion M1 is a maximum point of the curved line PL at the expanded portion 4*c*1. The first inflection portion U1 is a boundary portion between a part where the peripheral wall 4*c* approaches the rotation shaft RS and a part where the peripheral wall 4*c* separates from the rotation shaft RS, from the inner end 41*a* toward the closest portion 41*c*. In other words, the first inflection portion U1 is a boundary portion between a part where the peripheral wall 4*c* approaches the outer peripheral portion FL of the fan 2 and a part where the peripheral wall 4*c* separates from the outer peripheral portion FL of the fan 2, from the inner end 41*a* toward the closest portion 41*c*. The second inflection portion M1 is a boundary portion between the part where the peripheral wall 4*c* separates from the rotation shaft RS and a part where the peripheral wall 4*c* approaches the rotation shaft RS, from the inner end 41*a* toward the closest portion 41*c*. In other words, the second inflection portion M1 is a boundary portion of the part where the peripheral wall 4*c* separates from the outer peripheral portion FL of the fan 2 and a part where the peripheral wall 4*c* approaches the outer peripheral portion FL of the fan 2, from the inner end 41*a* toward the closest portion 41*c*. That is, as illustrated in FIG. 4, in terms of the relationship between the angle θP and the distance LP, the expanded portion 4*c*1 of the peripheral wall 4*c* is formed to have a downwardly protruding curved line and an upwardly protruding curved line in the direction from the inner end 41*a* toward the closest portion 41*c*. Further, the peripheral wall 4*c* is configured to gradually separate from the rotation shaft RS, from the first inflection portion U1 to the second inflection portion M1 in the rotation direction R. That is, the peripheral wall 4*c* is configured to gradually separate from the outer peripheral portion FL of the fan 2, from the first inflection portion U1 to the second inflection portion M1 in the rotation direction R. Accordingly, in the centrifugal fan 1, the gas flow passage between the first inflection portion U1 and the second inflection portion M1 widens in the rotation direction R.

As described above, the distance between the outer peripheral portion FL of the fan 2 and the rotation shaft RS is constant throughout. Further, the peripheral wall 4*c* from the inner end 41*a* to the expanded portion 4*c*1 in the rotation direction R of the fan 2 is formed such that the distance LP decreases at a constant rate as the angle θ increases from the inner end 41*a* toward the closest portion 41*c*. Therefore, in the centrifugal fan 1, the distance between the peripheral wall 4*c* and the blades 2*d* gradually decreases from the inner end 41*a* toward the expanded portion 4*c*1. Further, the centrifugal fan 1 includes the expanded portion 4*c*1. The distance between the peripheral wall 4*c* and the blades 2*d* at the expanded portion 4*c*1 is increased, compared to the distance between the peripheral wall 4*c* and the blades 2*d* in the region from the inner end 41*a* to the expanded portion 4*c*1. Note that the tongue portion 43 is formed on the upstream side of the airflow with respect to the inner end 41*a*, and the inner end 41*a* is formed at the downstream end of the tongue portion 43. With the configuration described above, in the centrifugal fan 1, the distance between the peripheral wall 4*c* and the outer peripheral portion FL of the fan 2 is gradually reduced from the tongue portion 43 toward the closest portion 41*c*, and then the distance between the peripheral wall 4*c* and the outer peripheral portion FL of the fan 2 is increased in front of the closest portion 41*c*. That is, in the scroll casing 4, the gas flow passage formed between the peripheral wall 4*c* and the outer peripheral portion FL of the fan 2 is gradually narrowed at the narrowed portion 4*d* from the inner end 41*a* toward the closest portion 41*c*, and then the gas flow passage is widened at the expanded portion 4*c*1.

When the fan 2 rotates, the air outside the scroll casing 4 is suctioned into the scroll casing 4 through the air inlet 5. The air suctioned into the scroll casing 4 is guided by the bell mouth 3 and suctioned into the fan 2. In the course of passing between the plurality of blades 2*d*, the air suctioned into the fan 2 is turned into an airflow with a dynamic pressure and a static pressure applied thereto, and is blown out to the radially outer side of the fan 2. In the airflow blown out from the fan 2, the dynamic pressure is converted into static pressure while the airflow is guided between the inner side of the peripheral wall 4*c* and the blades 2*d* in the scroll portion 41. The airflow passes through the scroll portion 41, and then is blown out to the outside of the scroll casing 4 from the air outlet 42*a* formed in the outlet portion 42.

The centrifugal fan 1 includes the narrowed portion 4*d* at which the distance between the peripheral wall 4*c* and the rotation shaft RS decreases from the inner end 41*a* toward the closest portion 41*c* in the rotation direction R of the fan 2. The centrifugal fan further includes the expanded portion 4*c*1 that is formed between the narrowed portion 4*d* and the closest portion 41*c* and at which the distance between the peripheral wall 4*c* and the rotation shaft RS is increased. Therefore, in the centrifugal fan 1, the distance between the peripheral wall 4*c* and the outer peripheral portion FL of the fan 2 is gradually reduced from the tongue portion 43 toward the closest portion 41*c*, and then the distance between the peripheral wall 4*c* and the outer peripheral portion FL of the fan 2 is increased in front of the closest portion 41*c*. In the centrifugal fan 1, since the distance between the peripheral wall 4*c* and the outer peripheral portion FL of the fan 2 is increased in front of the closest portion 41*c*, the air volume is secured. Further, as the gas of the secured volume passes through the closest portion 41*c*, the velocity of the gas is increased. Accordingly, the centrifugal fan 1 can effectively increase the pressure in the scroll portion 41.

Further, in the scroll casing 4, the gas flow passage formed between the peripheral wall 4*c* and the outer peripheral portion FL of the fan 2 is gradually narrowed at the narrowed portion 4*d* from the inner end 41*a* toward the closest portion 41*c*, and then the flow passage is widened at the expanded portion 4*c*1. In the centrifugal fan 1, since the distance between the peripheral wall 4*c* and the outer peripheral portion FL of the fan 2 is increased in front of the closest portion 41*c*, the air volume is secured. Further, as the gas of the secured volume passes through the closest portion 41*c*, the velocity of the gas is increased. Accordingly, the centrifugal fan 1 can effectively increase the pressure in the scroll portion 41.

Compared to a virtual reference wall configured such that the peripheral wall 4*c* approaches the rotation shaft RS at a constant rate from the inner end 41*a* toward the closest portion 41*c*, the expanded portion 4*c*1 expands in the radial direction of the fan 2. Since the distance between the peripheral wall 4*c* and the outer peripheral portion FL of the fan 2 is increased in front of the closest portion 41*c*, the centrifugal fan 1 can secure the air volume. Further, as the gas of the secured volume passes through the closest portion 41*c*, the velocity of the gas is increased. Accordingly, the centrifugal fan 1 can effectively increase the pressure in the scroll portion 41.

The peripheral wall 4*c* includes the first inflection portion U1 defining a boundary portion between a part where the peripheral wall 4*c* approaches the rotation shaft RS and a part where the peripheral wall 4*c* separates from the rotation shaft RS, and the second inflection portion M1 defining a boundary portion between the part where the peripheral wall 4*c* separates from the rotation shaft RS and a part where the peripheral wall 4*c* approaches the rotation shaft RS. In the centrifugal fan 1, since the distance between the peripheral wall 4*c* and the outer peripheral portion FL of the fan 2 is increased in front of the closest portion 41*c*, the air volume is secured. Further, as the gas of the secured volume passes through the closest portion 41*c*, the velocity of the gas is increased. Accordingly, the centrifugal fan 1 can effectively increase the pressure in the scroll portion 41.

Further, the peripheral wall 4*c* is configured to gradually separate from the rotation shaft RS, from the first inflection portion U1 to the second inflection portion M1. Since the distance between the peripheral wall 4*c* and the outer peripheral portion FL of the fan 2 is increased in front of the closest portion 41*c*, the centrifugal fan 1 can secure the air volume. Further, as the gas of the secured volume passes through the closest portion 41*c*, the velocity of the gas is increased. Accordingly, the centrifugal fan 1 can effectively increase the pressure in the scroll portion 41.

The distance between the peripheral wall 4*c* and the rotation shaft RS at the expanded portion 4*c*1 is less than the distance between the peripheral wall 4*c* and the rotation shaft RS at the inner end 41*a*. Therefore, the centrifugal fan 1 can maintain the velocity of the gas in the flow passage increased at the narrowed portion 4*d* to some extent, and can reduce separation of the gas.

Since the closest portion 41*c* at which the distance between the peripheral wall 4*c* and the outer peripheral portion FL of the fan 2 is minimum is shifted from the tongue portion 43 in the rotation direction R of the fan 2, the centrifugal fan 1 can reduce a sudden pressure difference in the tongue portion 43, and reduce the noise level.

Figure 5:
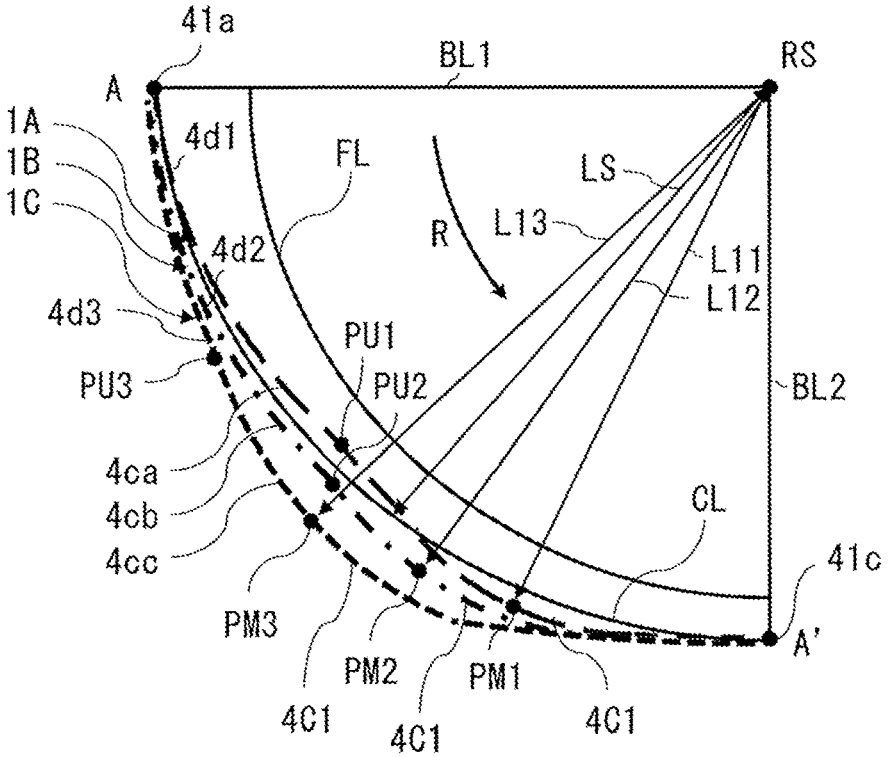
FIG. 5 is an enlarged view of modified examples of the centrifugal fan according to Embodiment 1 of the present disclosure.
Figure 6:
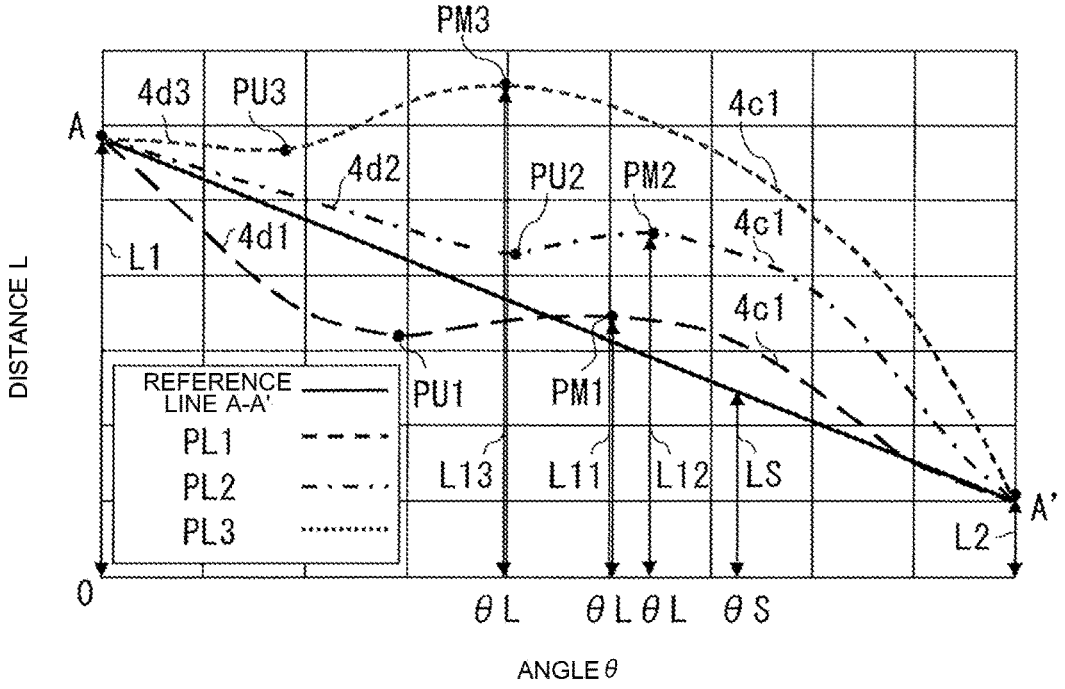
FIG. 6 is a graph illustrating a relationship between an angle θ and a distance L in each of the modified examples of the centrifugal fan according to Embodiment 1 of the present disclosure and the centrifugal fan of the comparative example.

FIG. 5 is an enlarged view of modified examples of the centrifugal fan 1 according to Embodiment 1 of the present disclosure. FIG. 6 is a graph illustrating a relationship between the angle θ and the distance L in each of the modified examples of the centrifugal fan 1 according to Embodiment 1 of the present disclosure and the centrifugal fan of the comparative example. The centrifugal fans 1A, 1B, and 1C as modified examples of the centrifugal fan 1 will be described with reference to FIGS. 5 and 6. Note that parts having the same configurations as those of the centrifugal fan 1 in FIGS. 1 to 4 are denoted by the same reference numerals, and a description thereof will be omitted.

A distance L11 is the distance between a rotation shaft RS of the centrifugal fan 1A and a peripheral wall 4*ca* in the direction perpendicular to the rotation shaft RS of the centrifugal fan 1A. A distance L12 is the distance between a rotation shaft RS of the centrifugal fan 1B and a peripheral wall 4*cb* in the direction perpendicular to the rotation shaft RS of the centrifugal fan 1B. A distance L13 is the distance between a rotation shaft RS of the centrifugal fan 1C and a peripheral wall 4*cc* in the direction perpendicular to the rotation shaft RS of the centrifugal fan 1C. Note that each of the peripheral wall 4*ca* of the centrifugal fan 1A, the peripheral wall 4*cb* of the centrifugal fan 1B, and the peripheral wall 4*cc* of the centrifugal fan 1A is a wall portion corresponding to the peripheral wall 4*c* of the centrifugal fan 1.

The angle θP described above represents the angle in the circumferential direction rotated from the inner end 41*a* to a measurement position of the distance L11 about the rotation shaft RS when the centrifugal fan 1A is viewed in plan view in the axial direction of the rotation shaft RS. The angle θP described above also represents the angle rotated about the rotation shaft RS from the inner end 41*a* to a measurement position of the distance L12 in the circumferential direction when the centrifugal fan 1B is viewed in plan view in the axial direction of the rotation shaft RS. The angle θP described above also represents the angle rotated about the rotation shaft RS from the inner end 41*a* to a measurement position of the distance L13 in the circumferential direction when the centrifugal fan 1C is viewed in plan view in the axial direction of the rotation shaft RS.

A curved line PL1 indicated by the long-dashed line in FIG. 6 represents a relationship between the angle θP and the distance L11 in the region from the inner end 41*a* to the closest portion 41*c*. Similarly, a curved line PL2 indicated by the one-dot chain line in FIG. 6 represents a relationship between the angle θP and the distance L12 in the region from the inner end 41*a* to the closest portion 41*c*. Similarly, a curved line PL3 indicated by the short-dashed line in FIG. 6 represents a relationship between the angle θP and the distance L13 in the region from the inner end 41*a* to the closest portion 41*c*. As illustrated in FIGS. 5 and 6, each of the peripheral walls 4*ca*, 4*cb*, and 4*cc* includes an expanded portion 4*c*1 between the inner end 41*a* and the closest portion 41*c*.

Note that as illustrated in FIG. 6, the peripheral wall 4*ca* from the inner end 41*a* to the expanded portion 4*c*1 in the rotation direction R of the fan 2 includes a narrowed portion 4*d*1 at which the distance L11 decreases as the angle θ increases from the inner end 41*a* toward the closest portion 41*c*. Similarly, the peripheral wall 4*cb* from the inner end 41*a* to the expanded portion 4*c*1 in the rotation direction R of the fan 2 includes a narrowed portion 4*d*2 at which the distance L12 decreases at a constant rate as the angle θ increases from the inner end 41*a* toward the closest portion 41*c*. Similarly, the peripheral wall 4*cc* from the inner end 41*a* to the expanded portion 4*c*1 in the rotation direction R of the fan 2 includes a narrowed portion 4*d*3 at which the distance L13 decreases at a constant rate as the angle θ increases from the inner end 41*a* toward the closest portion 41*c*.

As illustrated in FIGS. 5 and 6, the peripheral wall 4*ca* includes a first inflection portion PU1 and a second inflection portion PM1. As illustrated in FIG. 6, the first inflection portion PU1 is a minimum point of the curved line PL1, and the second inflection portion PM1 is a maximum point of the curved line PL1. That is, as illustrated in FIG. 6, in terms of the relationship between the angle θP and the distance L11, the peripheral wall 4*ca* is formed to have a downwardly protruding curved line and an upwardly protruding curved line in the direction from the inner end 41*a* toward the closest portion 41*c*. Further, the peripheral wall 4*ca* is configured such that a wall portion between the first inflection portion PU1 and the second inflection portion PM1 separates from the outer peripheral portion FL of the fan 2 in the rotation direction R. Accordingly, the peripheral wall 4*ca* is configured such that the gas flow passage between the first inflection portion PU1 and the second inflection portion PM1 widens in the rotation direction R.

As illustrated in FIG. 6, the peripheral wall 4*ca* is configured such that the first inflection portion PU1 is located below the reference line A-A'. That is, the peripheral wall 4*ca* is configured such that a wall portion from the inner end 41*a* to the first inflection portion U1 approaches the outer peripheral portion FL of the fan 2 in the rotation direction R. Accordingly, the peripheral wall 4*ca* is configured such that the gas flow passage between the inner end 41*a* and the first inflection portion U1 narrows in the rotation direction R. As a result, the centrifugal fan 1A can reduce a sudden pressure difference in the tongue portion 43, and further reduce the noise level.

The peripheral wall 4*ca* is configured such that the gas flow passage between the inner end 41*a* and the first inflection portion U1 narrows, and then the gas flow passage widens at the expanded portion 4*c*1, in the rotation direction R. Accordingly, the centrifugal fan 1A can accelerate the gas between the inner end 41*a* and the first inflection portion U1 where the gas flow passage narrows, increase the air volume at the expanded portion 4*c*1, and increase the pressure at the closest portion 41*c*. With the configuration and operation described above, the centrifugal fan 1A can even out the air velocity around the closest portion 41*c*, and balance the pressure.

As illustrated in FIGS. 5 and 6, the peripheral wall 4*cb* includes a first inflection portion PU2 and a second inflection portion PM2 at the expanded portion 4*c*1. As illustrated in FIG. 6, the first inflection portion PU2 is a minimum point of the curved line PL2 at the expanded portion 4*c*1, and the second inflection portion PM2 is a maximum point of the curved line PL2 at the expanded portion 4*c*1. That is, as illustrated in FIG. 6, in terms of the relationship between the angle θP and the distance L12, the expanded portion 4*c*1 of the peripheral wall 4*cb* is formed to have a downwardly protruding curved line and an upwardly protruding curved line in the direction from the inner end 41*a* toward the closest portion 41*c*. Further, the peripheral wall 4*cb* is configured such that a wall portion between the first inflection portion PU2 and the second inflection portion PM2 separates from the outer peripheral portion FL of the fan 2 in the rotation direction R. Accordingly, the peripheral wall 4*cb* is configured such that the gas flow passage between the first inflection portion PU2 and the second inflection portion PM2 widens in the rotation direction R.

The peripheral wall 4*cb* is configured such that a wall portion from the inner end 41*a* to a first inflection portion U2 approaches the outer peripheral portion FL of the fan 2 in the rotation direction R. Accordingly, the peripheral wall 4*cb* is configured such that the gas flow passage between the inner end 41*a* and the first inflection portion U2 narrows in the rotation direction R. However, as illustrated in FIG. 6, the peripheral wall 4*cb* is configured such that the first inflection portion PU2 is located above the reference line A-A'. Accordingly, in the centrifugal fan 1B, the rate at which the peripheral wall 4*cb* approaches the outer peripheral portion FL of the fan 2 is less than the rate at which the reference peripheral wall CL approaches the outer peripheral portion FL of the fan 2, in the rotation direction R. Compared to the centrifugal fan of the comparative example, the centrifugal fan 1B makes it possible to increase the capacity of the gas flow passage between the peripheral wall 4*cb* and the outer peripheral portion FL of the fan 2, and increase the suction air volume.

As illustrated in FIGS. 5 and 6, the peripheral wall 4*cc* includes a first inflection portion PU3 and a second inflection portion PM3 at the expanded portion 4*c*1. As illustrated in FIG. 6, the first inflection portion PU3 is a minimum point of the curved line PL3 at the expanded portion 4*c*1, and the second inflection portion PM3 is a maximum point of the curved line PL3 at the expanded portion 4*c*1. That is, as illustrated in FIG. 6, in terms of the relationship between the angle θP and the distance 13, the expanded portion 4*c*1 of the peripheral wall 4*cc* is formed to have a downwardly protruding curved line and an upwardly protruding curved line in the direction from the inner end 41*a* toward the closest portion 41*c*. Further, the peripheral wall 4*cc* is configured such that a wall portion between the first inflection portion PU3 and the second inflection portion PM3 separates from the outer peripheral portion FL of the fan 2 in the rotation direction R. Accordingly, the peripheral wall 4*cc* is configured such that the gas flow passage between the first inflection portion PU3 and the second inflection portion PM3 widens in the rotation direction R.

The peripheral wall 4*cc* is configured such that a wall portion from the inner end 41*a* to the first inflection portion U1 approaches the outer peripheral portion FL of the fan 2 in the rotation direction R. Accordingly, the peripheral wall 4*cc* is configured such that the gas flow passage between the inner end 41*a* and the first inflection portion U3 narrows in the rotation direction R. However, as illustrated in FIG. 6, the peripheral wall 4*cc* is configured such that the first inflection portion PU3 is located above the reference line A-A'. Accordingly, in the centrifugal fan 1C, the rate at which the peripheral wall 4*cc* approaches the outer peripheral portion FL of the fan 2 is less than the rate at which the reference peripheral wall CL approaches the outer peripheral portion FL of the fan 2, in the rotation direction R. In the centrifugal fan 1C, compared to the centrifugal fan of the comparative example, the capacity of the gas flow passage between the peripheral wall 4*cc* and the outer peripheral portion FL of the fan 2 is increased, so that the suction air volume can be increased. Further, the peripheral wall 4*cc* is configured such that the first inflection portion PU3 is closer to the inner end 41*a* than the first inflection portion PU2. Therefore, the centrifugal fan 1C has the expanded portion 4*c*1 greater than that of the centrifugal fan 1B. As a result, in the centrifugal fan 1C, compared to the centrifugal fan 1B, the capacity of the gas flow passage between the peripheral wall 4*cc* and the outer peripheral portion FL of the fan 2 is increased, so that the suction air volume can be increased.

The centrifugal fan 1 is preferably configured such that the curved line PL is located below a point A in FIG. 4. That is, the centrifugal fan 1 preferably includes the peripheral wall 4*c* formed such that the distance between the peripheral wall 4*c* and the rotation shaft RS is less than or equal to a distance L1 between the rotation shaft RS and the peripheral wall 4*c* at the inner end 41*a*. Accordingly, in the centrifugal fan 1, the expanded portion 4*c*1 also preferably includes the peripheral wall 4*c* formed such that the distance between the peripheral wall 4*c* and the rotation shaft RS is less than or equal to the distance L1 between the rotation shaft RS and the peripheral wall 4*c* at the inner end 41*a*. Similarly, the centrifugal fan 1A preferably includes the peripheral wall 4*ca* formed such that the distance between the peripheral wall 4*ca* and the rotation shaft RS is less than or equal to the distance L1 between the rotation shaft RS and the peripheral wall 4*ca* at the inner end 41*a*. Similarly, the centrifugal fan 1B preferably includes the peripheral wall 4*cb* formed such that the distance between the peripheral wall 4*cb* and the rotation shaft RS is less than or equal to the distance L1 between the rotation shaft RS and the peripheral wall 4*cb* at the inner end 41*a*. Similarly, the centrifugal fan 1C preferably includes the peripheral wall 4*cc* formed such that the distance between the peripheral wall 4*cc* and the rotation shaft RS is less than or equal to the distance L1 between the rotation shaft RS and the peripheral wall 4*cc* at the inner end 41*a*. With this configuration, the centrifugal fans 1, 1A, 1B, and 1C can accelerate the gas in the flow passage, and reduce separation of the gas.

Embodiment 2

Figure 7:
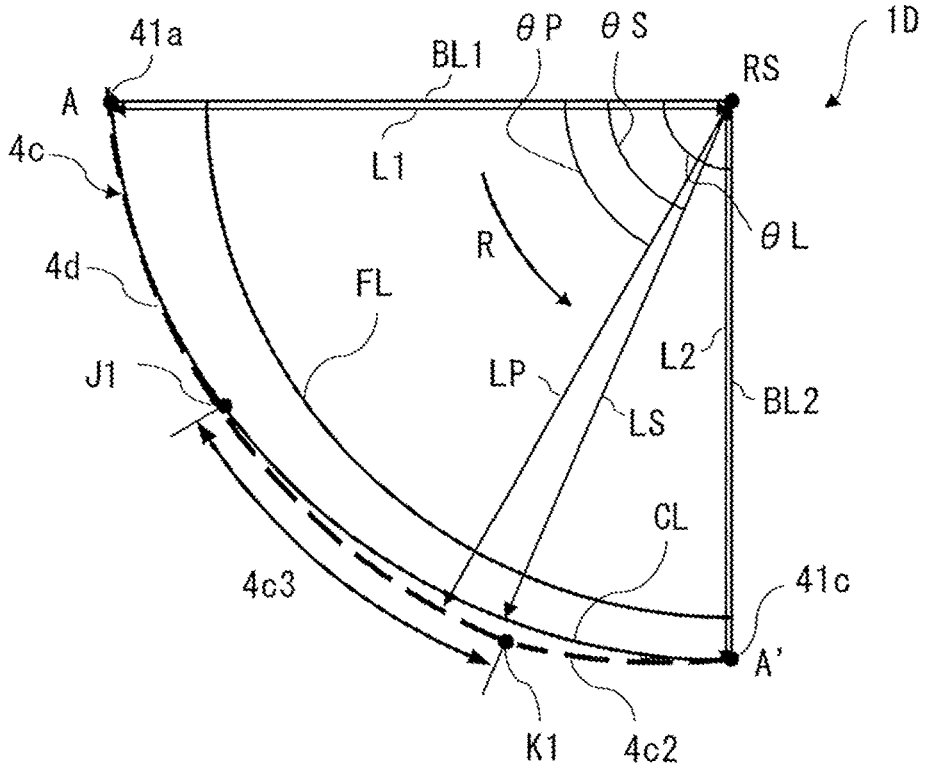
FIG. 7 is a partially enlarged view of a centrifugal fan according to Embodiment 2 of the present disclosure.
Figure 8:
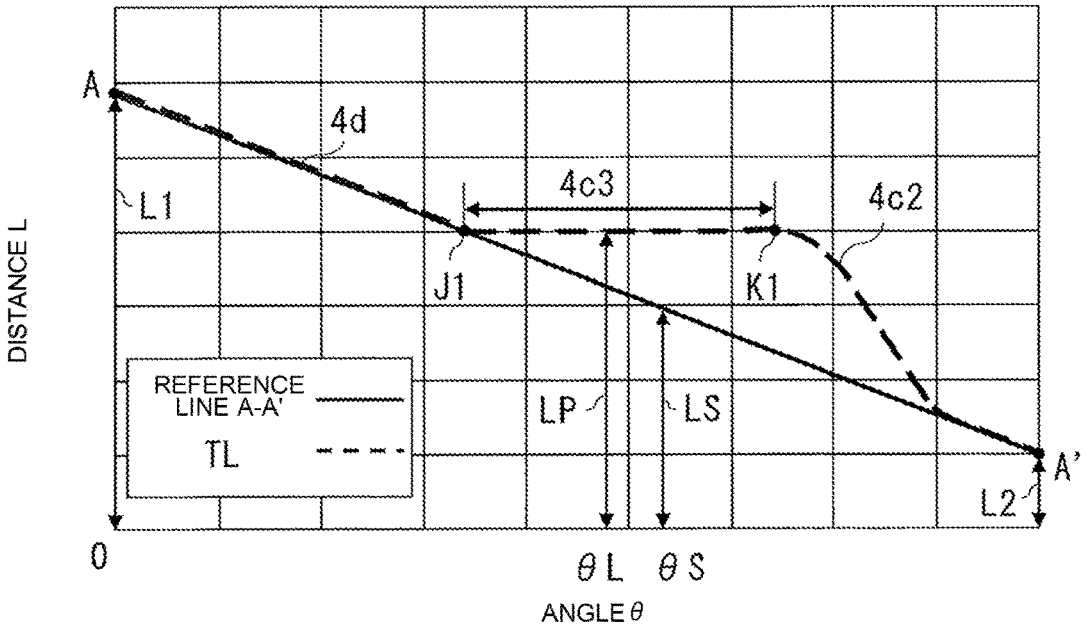
FIG. 8 is a graph illustrating a relationship between an angle θ and a distance L in each of the centrifugal fan of FIG. 7 and the centrifugal fan of the comparative example.

FIG. 7 is a partially enlarged view of the centrifugal fan 1D according to Embodiment 2 of the present disclosure. FIG. 8 is a graph illustrating a relationship between the angle θ and the distance L in each of the centrifugal fan 1D of FIG. 7 and the centrifugal fan of the comparative example. Note that parts having the same configurations as those of the centrifugal fan 1 and the other centrifugal fans in FIGS. 1 to 6 are denoted by the same reference numerals, and a description thereof will be omitted. The centrifugal fan 1D of Embodiment 2 differs from the centrifugal fan 1 of Embodiment 1 in the shape of the peripheral wall 4*c*. Accordingly, the configuration of the peripheral wall 4*c* of the centrifugal fan 1D of Embodiment 2 will mainly be described with reference to FIGS. 7 and 8.

A curved line TL indicated by the long-dashed line in FIG. 8 represents a relationship between the angle θP and the distance LP in the region from the inner end 41*a* to the closest portion 41*c*. As illustrated in FIGS. 7 and 8, the peripheral wall 4*c* includes an expanded portion 4*c*2 between the inner end 41*a* and the closest portion 41*c*. As illustrated in FIGS. 7 and 8, the expanded portion 4*c*2 is a portion of the peripheral wall 4*c* at which the distance LP between the rotation shaft RS and the peripheral wall 4*c* is greater than or equal to the distance LS between the rotation shaft RS and the reference peripheral wall CL. That is, compared to the virtual reference peripheral wall CL configured such that the peripheral wall 4*c* approaches the rotation shaft RS at a constant rate from the inner end 41*a* toward the closest portion 41*c*, the expanded portion 4*c*2 is formed such that a part of the peripheral wall 4*c* expands in the radial direction of the fan 2. The expanded portion 4*c*2 is a portion that is located on the inner end 41*a* side of the closest portion 41*c* and at which the distance between the peripheral wall 4*c* and the rotation shaft RS is increased. In other words, the expanded portion 4*c*2 is a portion that is located on the inner end 41*a* side of the closest portion 41*c* and at which the distance between the peripheral wall 4*c* and the outer peripheral portion FL of the fan 2 is increased.

As illustrated in FIG. 8, the peripheral wall 4*c* includes a narrowed portion 4*d* at which the distance between the peripheral wall 4*c* and the rotation shaft RS decreases from the inner end 41*a* toward the closest portion 41*c* in the rotation direction R of the fan 2. The narrowed portion 4*d* is a portion of the peripheral wall 4*c* at which the distance between the peripheral wall 4*c* and the outer peripheral portion FL of the fan 2 decreases from the inner end 41*a* toward the closest portion 41*c* in the rotation direction R of the fan 2. The narrowed portion 4*d* is formed to extend from the inner end 41*a* to the expanded portion 4*c*2 in the rotation direction R of the fan 2 such that the distance LP decreases at a constant rate as the angle θ increases from the inner end 41*a* toward the closest portion 41*c*. Note that the rate at which the distance LP decreases as the angle θ increases is equal to the rate at which the distance LS decreases as the angle θ increases. That is, the peripheral wall 4*c* from the inner end 41*a* to the expanded portion 4*c*2 is formed such that the curved line TL has the same inclination as the reference line A-A'.

As illustrated in FIGS. 7 and 8, the peripheral wall 4*c* includes a first inflection portion J1 and a second inflection portion K1 at the expanded portion 4*c*2. The first inflection portion J1 is a boundary portion between a part where the peripheral wall 4*c* approaches the rotation shaft RS and a part where the distance between the peripheral wall 4*c* and the rotation shaft RS is constant, from the inner end 41*a* toward the closest portion 41*c*. In other words, the first inflection portion J1 is a boundary portion between a part where the peripheral wall 4*c* approaches the outer peripheral portion FL of the fan 2 and a part where the distance between the peripheral wall 4*c* and the outer peripheral portion FL of the fan 2 is constant, from the inner end 41*a* toward the closest portion 41*c*. The second inflection portion K1 is a boundary portion between the part where the distance between the peripheral wall 4*c* and the rotation shaft RS is constant and a part where the peripheral wall 4*c* approaches the rotation shaft RS, from the inner end 41*a* toward the closest portion 41*c*. In other words, the second inflection portion K1 is a boundary portion of the part where the distance between the peripheral wall 4*c* and the outer peripheral portion FL of the fan 2 is constant and a part where the peripheral wall 4*c* approaches the outer peripheral portion FL of the fan 2, from the inner end 41*a* toward the closest portion 41*c*.

The peripheral wall 4*c* includes a constant distance portion 4*c*3 defining the peripheral wall 4*c* between the first inflection portion J1 and the second inflection portion K1. The constant distance portion 4*c*3 is a portion formed between the narrowed portion 4*d* and the closest portion 41*c* and at which the distance between the peripheral wall 4*c* and the rotation shaft RS is constant. In other words, the constant distance portion 4*c*3 is a portion formed between the narrowed portion 4*d* and the closest portion 41*c* and at which the distance between the peripheral wall 4*c* and the outer peripheral portion FL of the fan 2 is constant. The peripheral wall 4*c* is configured such that the distance LP decreases as the angle θ increases from the second inflection portion K1 toward the closest portion 41*c* in the rotation direction R of the fan 2.

As described above, the distance between the outer peripheral portion FL of the fan 2 and the rotation shaft RS is constant throughout. Further, the peripheral wall 4*c* from the inner end 41*a* to the expanded portion 4*c*2 in the rotation direction R of the fan 2 is formed such that the distance LP decreases at a constant rate as the angle θ increases from the inner end 41*a* toward the closest portion 41*c*. Therefore, in the centrifugal fan 1D, the distance between the peripheral wall 4*c* and the outer peripheral portion FL of the fan 2 gradually decreases from the inner end 41*a* toward the expanded portion 4*c*2. Further, the centrifugal fan 1D includes the expanded portion 4*c*2. The distance between the peripheral wall 4*c* and the blades 2*d* at the expanded portion 4*c*2 is greater than the distance between the peripheral wall 4*c* and the outer peripheral portion FL of the fan 2 in the region from the inner end 41*a* to the expanded portion 4*c*2. Further, the peripheral wall 4*c* includes the constant distance portion 4*c*3 at which the distance between the rotation shaft RS and the peripheral wall 4*c* is constant at the expanded portion 4*c*2. With the configuration described above, in the centrifugal fan 1D, the distance between the peripheral wall 4*c* and the outer peripheral portion FL of the fan 2 is gradually reduced from the tongue portion 43 toward the closest portion 41*c*, and then the distance between the peripheral wall 4*c* and the outer peripheral portion FL of the fan 2 is increased in front of the closest portion 41*c*. That is, in the scroll casing 4, the gas flow passage formed between the peripheral wall 4*c* and the outer peripheral portion FL of the fan 2 is gradually narrowed at the narrowed portion 4*d* from the inner end 41*a* toward the closest portion 41*c*, and then the flow passage widened at the expanded portion 4*c*2. Further, the centrifugal fan 1D includes the constant distance portion 4*c*3 at the peripheral wall 4*c* where the distance between the rotation shaft RS and the peripheral wall 4*c* is constant.

The centrifugal fan 1D includes the constant distance portion 4*c*3 at the peripheral wall 4*c* where the distance between the rotation shaft RS and the peripheral wall 4*c* is constant. Since the centrifugal fan 1D includes the constant distance portion 4*c*3, the distance between the rotation shaft RS and the peripheral wall 4*c* is constant, so that the variation in air velocity can be reduced. Therefore, the centrifugal fan 1D can reduce variation in wall surface pressure at the constant distance portion 4*c*3, and reduce the noise level.

The constant distance portion 4*c*3 is formed between the first inflection portion J1 and the second inflection portion K1. Since the centrifugal fan 1D includes the constant distance portion 4*c*3, the distance between the rotation shaft RS and the peripheral wall 4*c* is constant, so that the variation in air velocity can be reduced. Therefore, the centrifugal fan 1D can reduce variation in wall surface pressure in the constant distance portion 4*c*3, and reduce the noise level.

In the centrifugal fan 1D, the distance between the peripheral wall 4*c* and the outer peripheral portion FL of the fan 2 is gradually reduced from the tongue portion 43 toward the closest portion 41*c*, and then the distance between the peripheral wall 4*c* and the outer peripheral portion FL of the fan 2 is increased in front of the closest portion 41*c*. In the centrifugal fan 1D, since the distance between the peripheral wall 4*c* and the outer peripheral portion FL of the fan 2 is increased in front of the closest portion 41*c*, the air volume is secured. Further, as the gas of the secured volume passes through the closest portion 41*c*, the velocity of the gas is increased. Accordingly, the centrifugal fan 1 can effectively increase the pressure in the scroll portion 41.

Since the closest portion 41*c* at which the distance between the peripheral wall 4*c* and the rotation shaft RS is minimum is shifted from the tongue portion 43 in the rotation direction R of the fan 2, the centrifugal fan 1D can reduce a sudden pressure difference in the tongue portion 43, and reduce the noise level.

Figure 9:
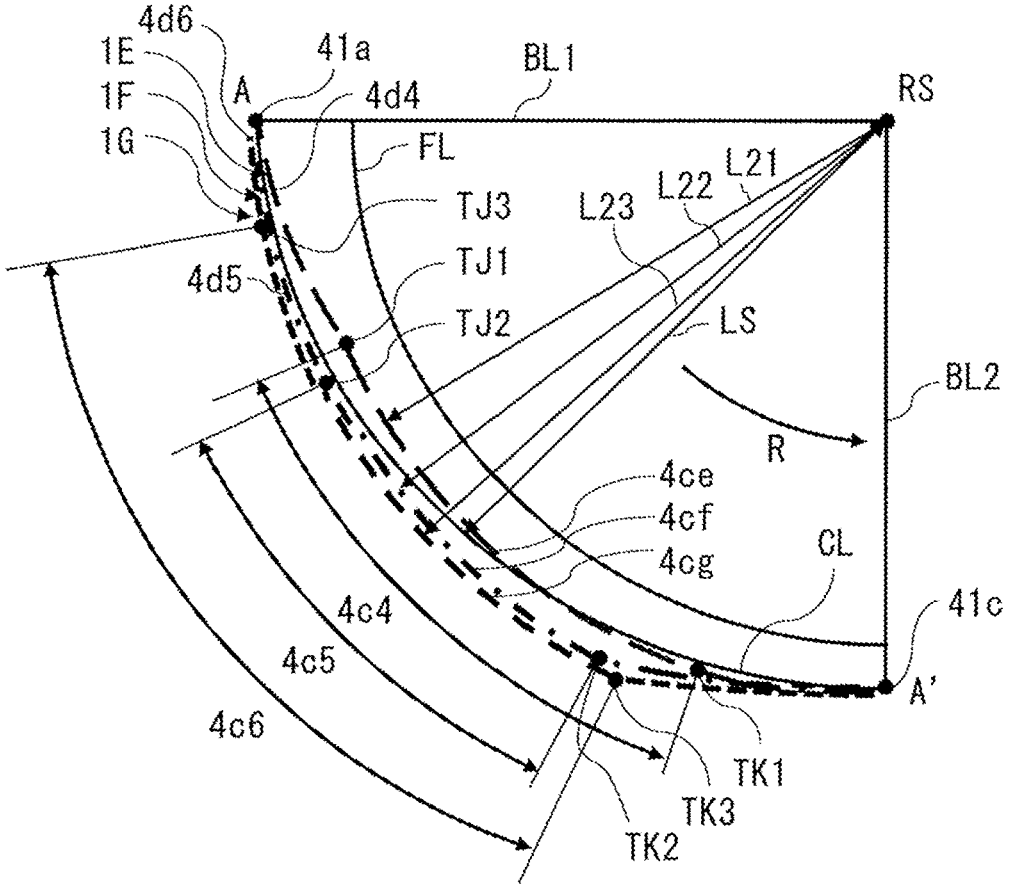
FIG. 9 is an enlarged view of modified examples of the centrifugal fan according to Embodiment 2 of the present disclosure.
Figure 10:
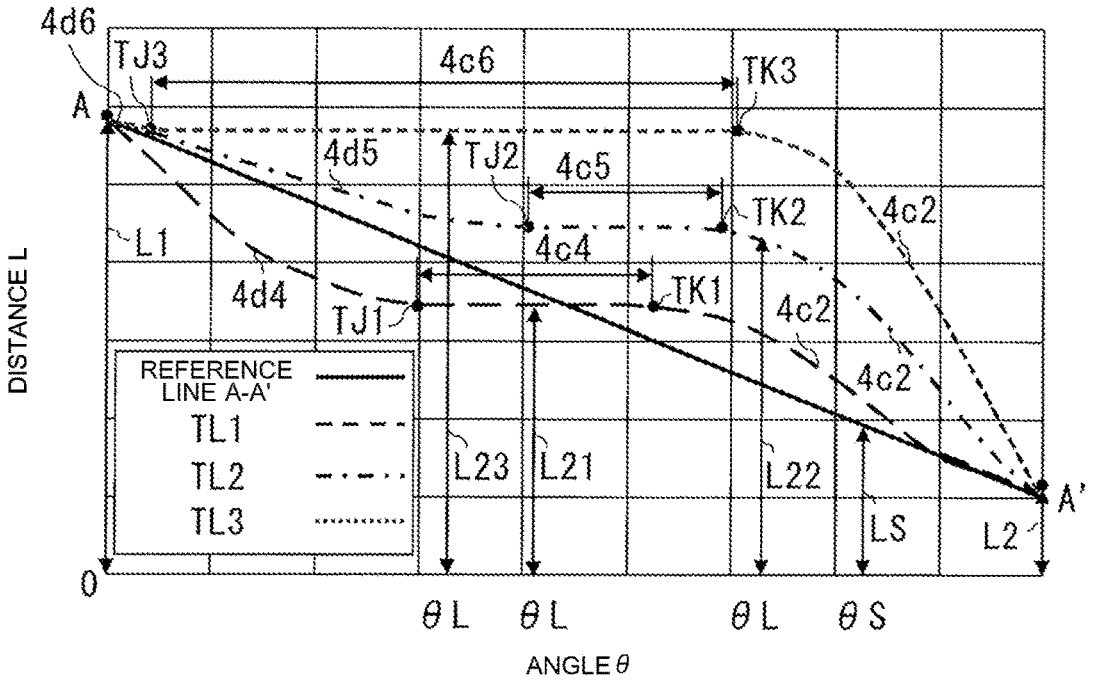
FIG. 10 is a graph illustrating a relationship between an angle θ and a distance L in each of the modified examples of the centrifugal fan according to Embodiment 2 of the present disclosure and the centrifugal fan of the comparative example.

FIG. 9 is an enlarged view of modified examples of the centrifugal fan 1D according to Embodiment 2 of the present disclosure. FIG. 10 is a graph illustrating a relationship between the angle θ and the distance L in each of the modified examples of the centrifugal fan 1D according to Embodiment 2 of the present disclosure and the centrifugal fan of the comparative example. The centrifugal fans 1E, 1F, and 1G as modified examples of the centrifugal fan 1D will be described with reference to FIGS. 9 and 10. Note that parts having the same configurations as those of the centrifugal fan 1 and other centrifugal fans in FIGS. 1 to 8 are denoted by the same reference numerals, and a description thereof will be omitted.

A distance L21 is the distance between a rotation shaft RS of the centrifugal fan 1E and a peripheral wall 4*ce* in the direction perpendicular to the rotation shaft RS of the centrifugal fan 1E. A distance L22 is the distance between a rotation shaft RS of the centrifugal fan 1F and a peripheral wall 4*cf* in the direction perpendicular to the rotation shaft RS of the centrifugal fan 1F. A distance L23 is the distance between a rotation shaft RS of the centrifugal fan 1G and a peripheral wall 4*cg* in the direction perpendicular to the rotation shaft RS of the centrifugal fan 1G. Note that each of the peripheral wall 4*ce* of the centrifugal fan 1E, the peripheral wall 4*cf* of the centrifugal fan 1F, and the peripheral wall 4*cg* of the centrifugal fan 1G is a wall portion corresponding to the peripheral wall 4*c* of the centrifugal fan 1D.

The angle θP described above represents the angle in the circumferential direction rotated from the inner end 41*a* to a measurement position of the distance L21 about the rotation shaft RS when the centrifugal fan 1E is viewed in plan view in the axial direction of the rotation shaft RS. The angle θP described above also represents the angle in the circumferential direction rotated from the inner end 41*a* to a measurement position of the distance L22 about the rotation shaft RS when the centrifugal fan 1F is viewed in plan view in the axial direction of the rotation shaft RS. The angle θP described above also represents the angle in the circumferential direction rotated from the inner end 41*a* to a measurement position of the distance L23 about the rotation shaft RS when the centrifugal fan 1G is viewed in plan view in the axial direction of the rotation shaft RS.

A curved line TL1 indicated by the long-dashed line in FIG. 10 represents a relationship between the angle θP and the distance L21 in the region from the inner end 41*a* to the closest portion 41*c*. Similarly, a curved line TL2 indicated by the one-dot chain line in FIG. 10 represents a relationship between the angle θP and the distance L22 in the region from the inner end 41*a* to the closest portion 41*c*. Similarly, a curved line TL3 indicated by the short-dashed line in FIG. 10 represents a relationship between the angle θP and the distance L23 in the region from the inner end 41*a* to the closest portion 41*c*. As illustrated in FIGS. 9 and 10, each of the peripheral walls 4*ce*, 4*cf*, and 4*cg* includes an expanded portion 4*c*2 between the inner end 41*a* and the closest portion 41*c*.

Note that as illustrated in FIGS. 9 and 10, the peripheral wall 4*ce* from the inner end 41*a* to the expanded portion 4*c*2 in the rotation direction R of the fan 2 includes a narrowed portion 4*d*4 at which the distance L21 decreases as the angle θ increases from the inner end 41*a* toward the closest portion 41*c*. Similarly, the peripheral wall 4*cf* from the inner end 41*a* to the expanded portion 4*c*2 in the rotation direction R of the fan 2 includes a narrowed portion 4*d*5 at which the distance L22 decreases at a constant rate as the angle θ increases from the inner end 41*a* toward the closest portion 41*c*. Similarly, the peripheral wall 4*cg* from the inner end 41*a* to the expanded portion 4*c*2 in the rotation direction R of the fan 2 includes a narrowed portion 4*d*6 at which the distance L23 decreases at a constant rate as the angle θ increases from the inner end 41*a* toward the closest portion 41*c*.

As illustrated in FIGS. 9 and 10, the peripheral wall 4*ce* includes a first inflection portion TJ1 and a second inflection portion TK1. The peripheral wall 4*ce* includes a constant distance portion 4*c*4 defining the peripheral wall 4*ce* between the first inflection portion TJ1 and the second inflection portion TK1. The constant distance portion 4*c*4 is a portion at which the distance between the rotation shaft RS and the peripheral wall 4*ce* is constant. In other words, the constant distance portion 4*c*4 is a portion at which the distance between the peripheral wall 4*ce* and the outer peripheral portion FL of the fan 2 is constant. The peripheral wall 4*ce* is configured such that the distance L21 decreases as the angle θ increases from the second inflection portion TK1 toward the closest portion 41*c*.

As illustrated in FIGS. 9 and 10, the peripheral wall 4*cf* includes a first inflection portion TJ2 and a second inflection portion TK2. The peripheral wall 4*cf* includes a constant distance portion 4*c*5 defining the peripheral wall 4*cf* between the first inflection portion TJ2 and the second inflection portion TK2. The constant distance portion 4*c*5 is a portion at which the distance between the rotation shaft RS and the peripheral wall 4*cf* is constant. In other words, the constant distance portion 4*c*5 is a portion at which the distance between the peripheral wall 4*cf* and the outer peripheral portion FL of the fan 2 is constant. Further, the peripheral wall 4*cf* is configured such that the distance 22 decreases as the angle θ increases from the second inflection portion TK2 toward the closest portion 41*c*.

As illustrated in FIGS. 9 and 10, the peripheral wall 4*cg* includes a first inflection portion TJ3 and a second inflection portion TK3. The peripheral wall 4*cg* includes a constant distance portion 4*c*6 defining the peripheral wall 4*cg* between the first inflection portion TJ3 and the second inflection portion TK3. The constant distance portion 4*c*6 is a portion at which the distance between the rotation shaft RS and the peripheral wall 4*cg* is constant. In other words, the constant distance portion 4*c*6 is a portion at which the distance between the peripheral wall 4*cg* and the outer peripheral portion FL of the fan 2 is constant. The peripheral wall 4*cg* is configured such that the distance L23 decreases as the angle θ increases from the second inflection portion TK3 toward the closest portion 41*c*.

As illustrated in FIG. 10, the constant distance portion 4*c*4 of the centrifugal fan 1E, the constant distance portion 4*c*5 of the centrifugal fan 1F, and the constant distance portion 4*c*6 of the centrifugal fan 1G differ from each other in length. That is, when the constant distance portion 4*c*3 is formed to have a length appropriate for the centrifugal fan 1D, the centrifugal fan 1D can reduce the variation in wall surface pressure, and reduce the noise level.

Embodiment 3

Figure 11:
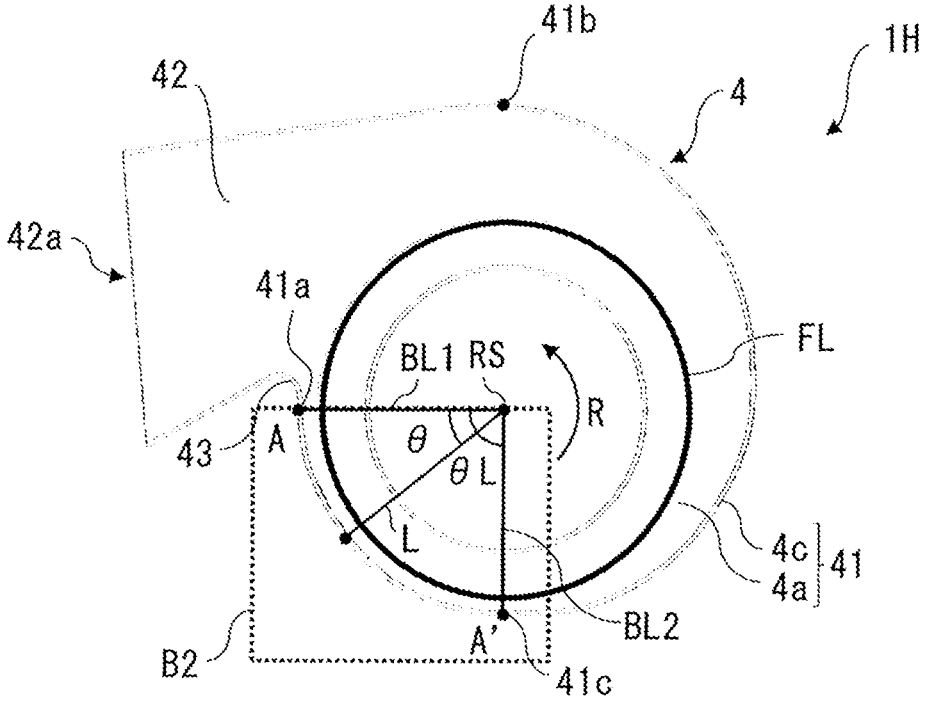
FIG. 11 is a schematic diagram of a centrifugal fan according to Embodiment 3 of the present disclosure as viewed from an air inlet side thereof.
Figure 12:
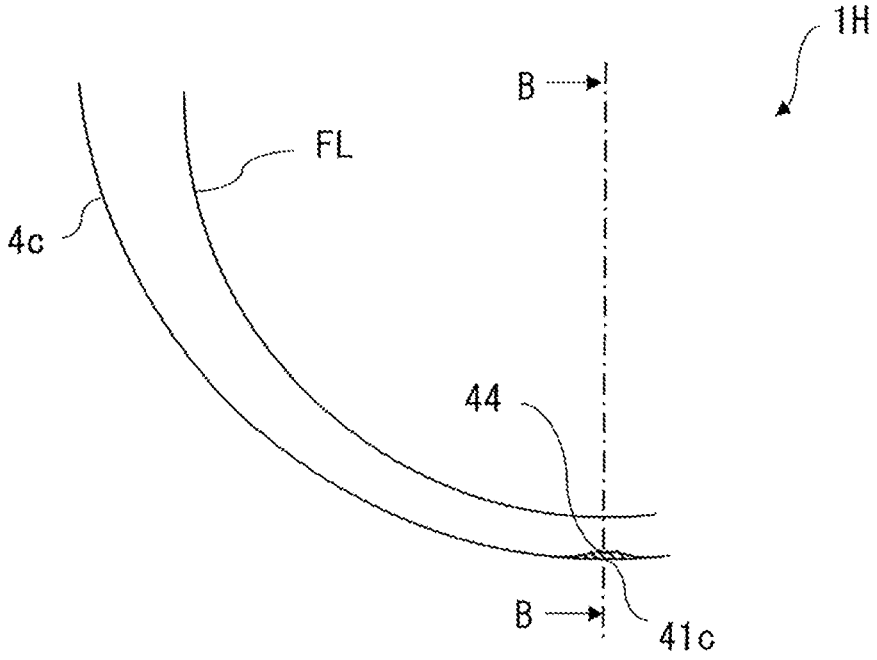
FIG. 12 is an enlarged view of a part B2 of the centrifugal fan of FIG. 11.
Figure 13:
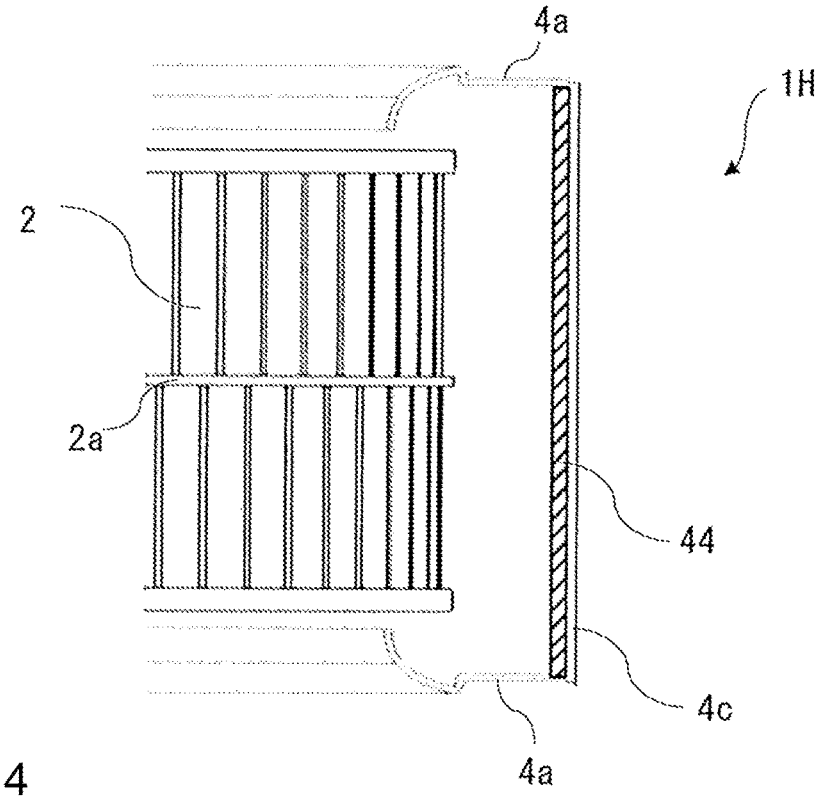
FIG. 13 is a cross-sectional view taken along line B-B of FIG. 12.

FIG. 11 is a schematic diagram of the centrifugal fan 1H according to Embodiment 3 of the present disclosure as viewed from an air inlet side thereof. FIG. 12 is an enlarged view of a part B2 of the centrifugal fan 1H of FIG. 11. FIG. 13 is a cross-sectional view taken along line B-B of FIG. 12. Note that parts having the same configurations as those of the centrifugal fan 1 and the other centrifugal fans in FIGS. 1 to 10 are denoted by the same reference numerals, and a description thereof will be omitted. The centrifugal fan 1H of Embodiment 3 differs from the centrifugal fan 1 of Embodiment 1 in the configuration of the peripheral wall 4*c*. Accordingly, the configuration of the peripheral wall 4*c* of the centrifugal fan 1H of Embodiment 3 will mainly be described with reference to FIGS. 11 to 13.

The centrifugal fan 1H includes a protrusion 44 at the closest portion 41*c* of the peripheral wall 4*c*. The protrusion 44 is a portion protruding from the inner wall of the peripheral wall 4*c* toward the inner side of the scroll casing 4. As illustrated in FIG. 12, the protrusion 44 is formed in a smooth protruding shape that protrudes most at the center in the circumferential direction, and decreases in wall thickness from the center toward the skirt. Note that the protrusion 44 only needs to have a shape that protrudes from the peripheral wall 4*c* toward the inner side of the scroll casing 4. The shape of the protrusion 44 is not limited to the smooth protruding shape that protrudes at the center in the circumferential direction as illustrated in FIG. 12, and may be any shape. As illustrated in FIG. 13, the protrusion 44 is formed to extend between the opposing side walls 4*a* in the rotation axis direction of the fan 2. The protrusion 44 is formed to have a uniform thickness along its entire length in the rotation axis direction of the fan 2.

The centrifugal fan 1H includes the protrusion 44 at the closest portion 41*c* of the peripheral wall 4*c* to narrow the flow passage, and thus can increase the velocity of the air flowing through the closest portion 41*c* while securing the suction air volume in the region from the tongue portion 43 to the closest portion 41*c*.

Figure 14:
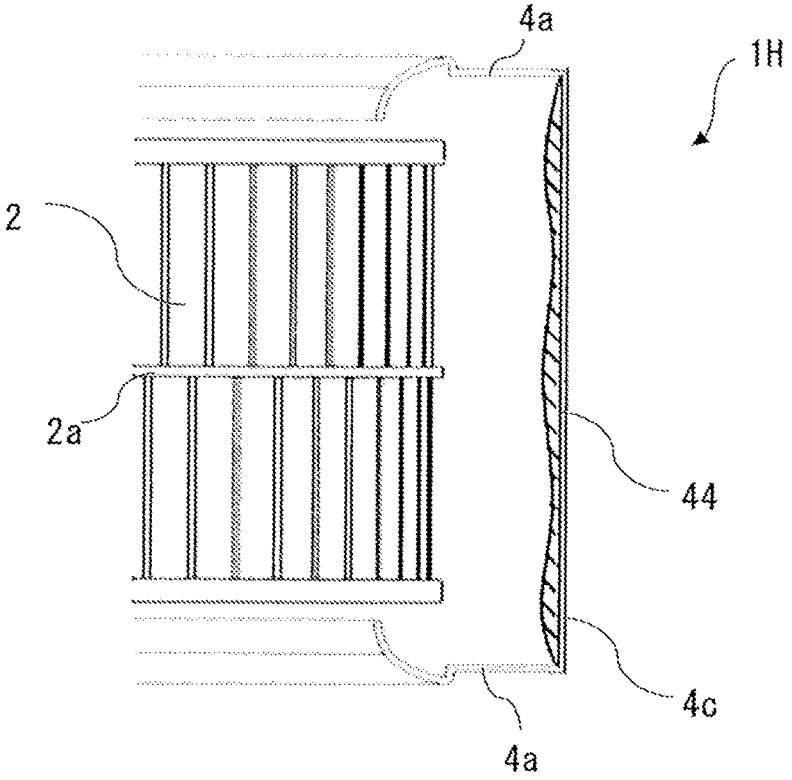
FIG. 14 is a cross-sectional view of a modified example 1 of the centrifugal fan according to Embodiment 3 of the present disclosure.
Figure 15:
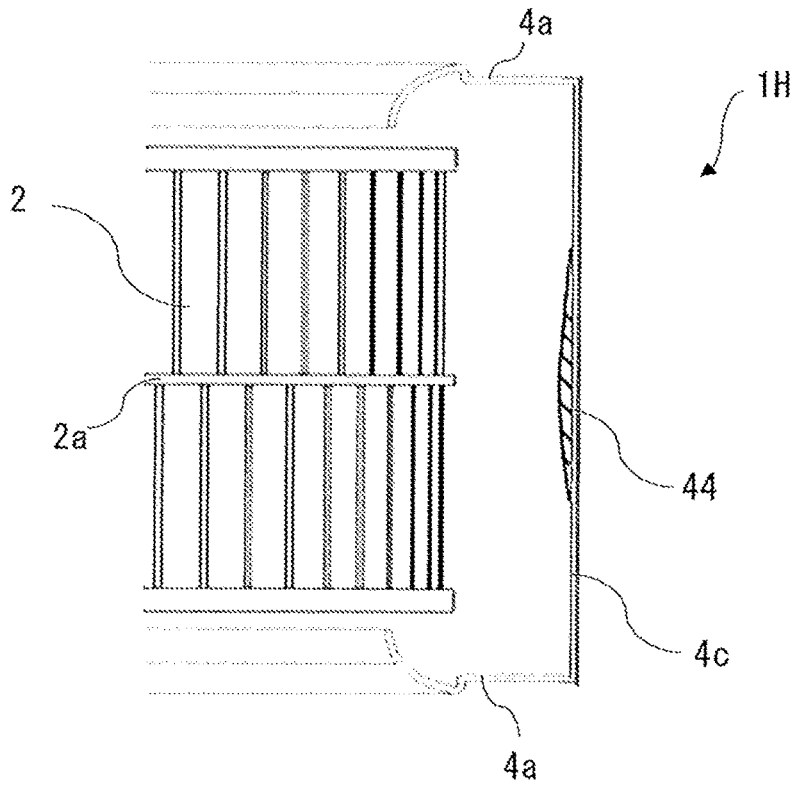
FIG. 15 is a cross-sectional view of a modified example 2 of the centrifugal fan according to Embodiment 3 of the present disclosure.
Figure 16:
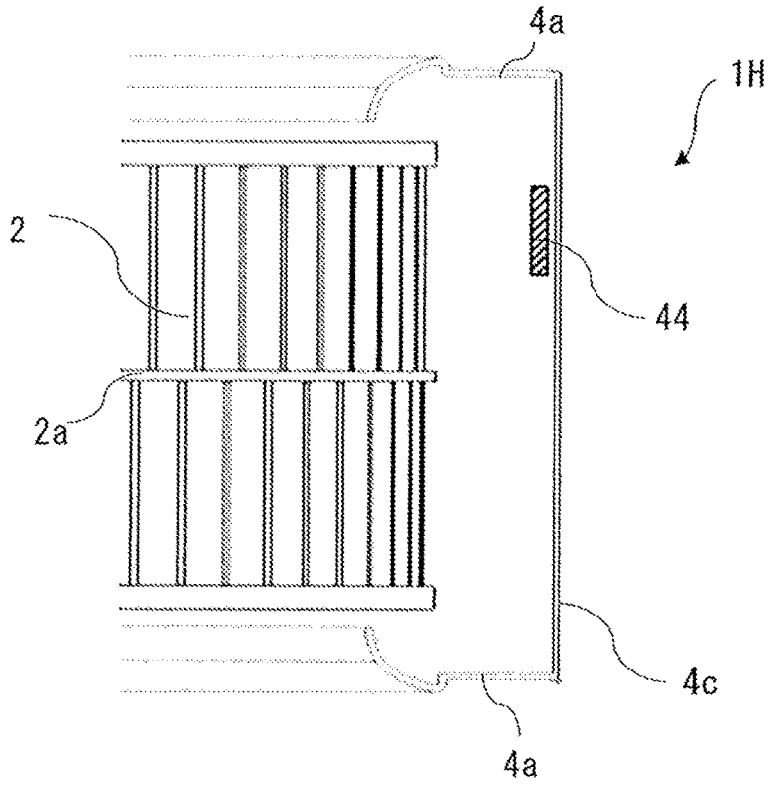
FIG. 16 is a cross-sectional view of a modified example 3 of the centrifugal fan according to Embodiment 3 of the present disclosure.
Figure 17:
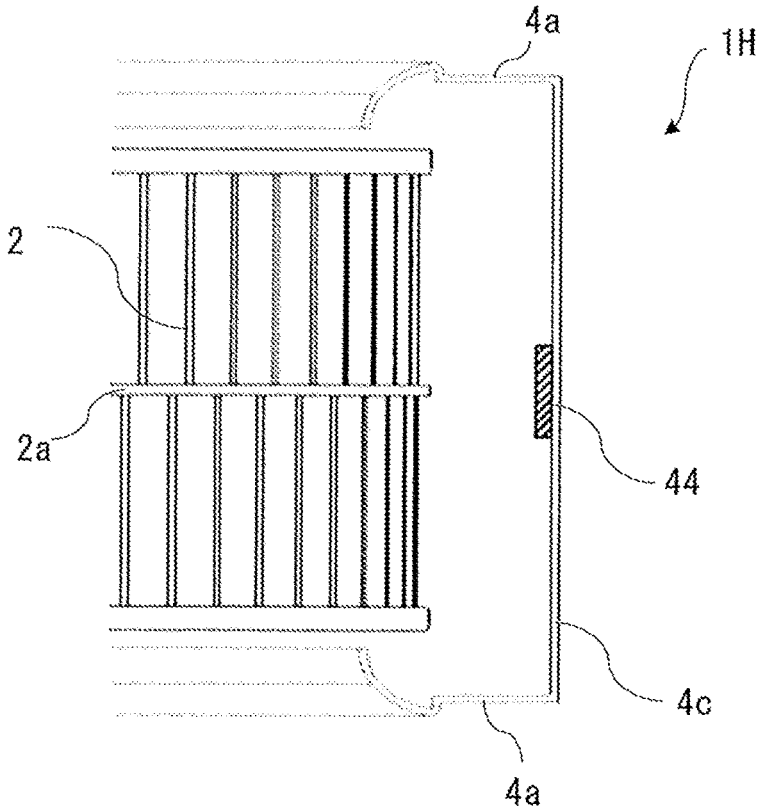
FIG. 17 is a cross-sectional view of a modified example 4 of the centrifugal fan according to Embodiment 3 of the present disclosure.
Figure 18:
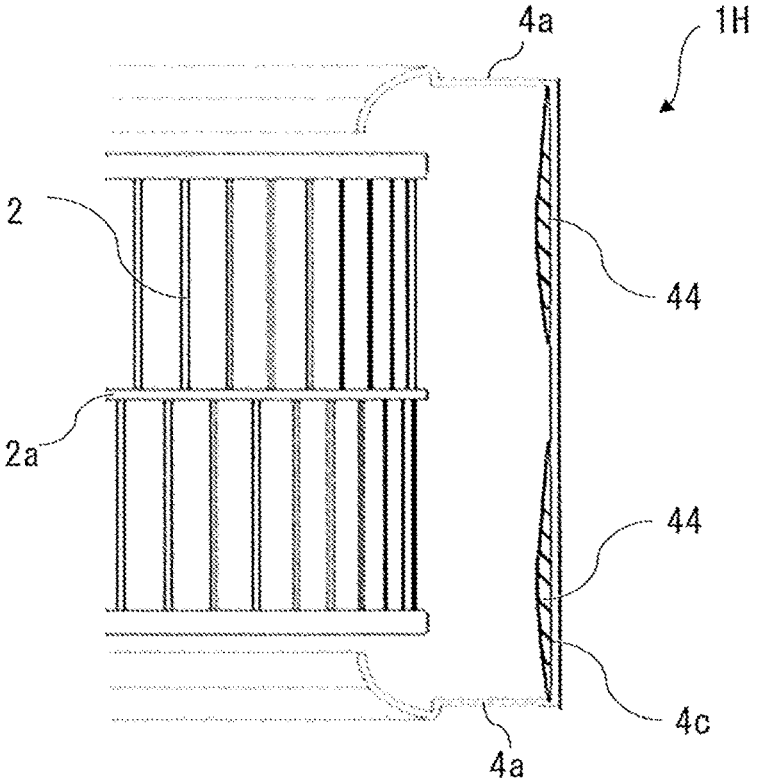
FIG. 18 is a cross-sectional view of a modified example 5 of the centrifugal fan according to Embodiment 3 of the present disclosure.

FIG. 14 is a cross-sectional view of a modified example 1 of the centrifugal fan 1H according to Embodiment 3 of the present disclosure. FIG. 15 is a cross-sectional view of a modified example 2 of the centrifugal fan 1H according to Embodiment 3 of the present disclosure. FIG. 16 is a cross-sectional view of a modified example 3 of the centrifugal fan 1H according to Embodiment 3 of the present disclosure. FIG. 17 is a cross-sectional view of a modified example 4 of the centrifugal fan 1H according to Embodiment 3 of the present disclosure. FIG. 18 is a cross-sectional view of a modified example 5 of the centrifugal fan 1H according to Embodiment 3 of the present disclosure. The shape of the protrusion 44 of the centrifugal fan 1H is not limited to the above-described shape having a uniform thickness along its entire length in the rotation axis direction of the fan 2. For example, as illustrated in FIG. 14, the protrusion 44 may be formed to extend between the opposing side walls 4*a* in the rotation axis direction of the fan 2, and have a thickness that varies along its length in the rotation axis direction of the fan 2. That is, the protrusion 44 may be formed to have a thickness that varies by location in the rotation axis direction of the fan 2, instead of having a uniform thickness.

As illustrated in FIG. 15, the protrusion 44 may be formed at the center portion of the peripheral wall 4*c* between the opposing side walls 4*a* in the rotation axis direction of the fan 2. Further, as illustrated in FIG. 15, the protrusion 44 may be formed to have a thickness that varies by location in the rotation axis direction of the fan 2, instead of having a uniform thickness.

As illustrated in FIG. 16, the protrusion 44 may be formed in a position shifted toward one of the side walls 4*a* from the center portion of the peripheral wall 4*c*, between the opposing side walls 4*a* in the rotation axis direction of the fan 2. Further, as illustrated in FIG. 16, the protrusion 44 may be formed to have a thickness that is uniform in the rotation axis direction of the fan 2, in the position shifted toward one of the side walls 4*a* from the center portion of the peripheral wall 4*c*.

As illustrated in FIG. 17, the protrusion 44 may be formed at the center portion of the peripheral wall 4*c* between the opposing side walls 4*a* in the rotation axis direction of the fan 2. Further, as illustrated in FIG. 17, the protrusion 44 may be formed to have a thickness that is uniform in the rotation axis direction of the fan 2, in a position at the center portion of the peripheral wall 4*c*.

As illustrated in FIG. 18, the protrusions 44 may be formed in positions shifted toward the respective side walls 4*a* from the center portion of the peripheral wall 4*c* in the rotation axis direction of the fan 2, between the opposing side walls 4*a*. That is, the protrusions 44 may be formed only near the side walls 4*a*, between the opposing side walls 4*a* in the rotation axis direction of the fan 2. Further, the protrusion 44 may be provided in plurality between the opposing side walls 4*a* in the rotation axis direction of the fan 2. Furthermore, as illustrated in FIG. 18, the protrusions 44 may be formed to have a thickness that varies by location in the rotation axis direction of the fan 2, instead of having a uniform thickness, in the positions shifted toward the respective side walls 4*a* from the center portion of the peripheral wall 4*c*.

As described above, the protrusion 44 may be formed across the peripheral wall 4*c* between the opposing side walls 4*a* as illustrated in FIGS. 13 and 14, or may be formed at part of the peripheral wall 4*c* between the opposing side walls 4*a* as illustrated in FIGS. 15 to 18. Further, as illustrated in FIG. 18, the protrusion 44 may be provided in plurality, and the protrusions 44 may be formed only near the side walls 4*a*. The shape of the protrusion 44 is a shape for evening out the air velocity in the closest portion 41*c* in the rotation axis direction of the fan 2, and may have any shape such as a wave shape and a rectangular shape in cross section.

Embodiment 4

Figure 19:
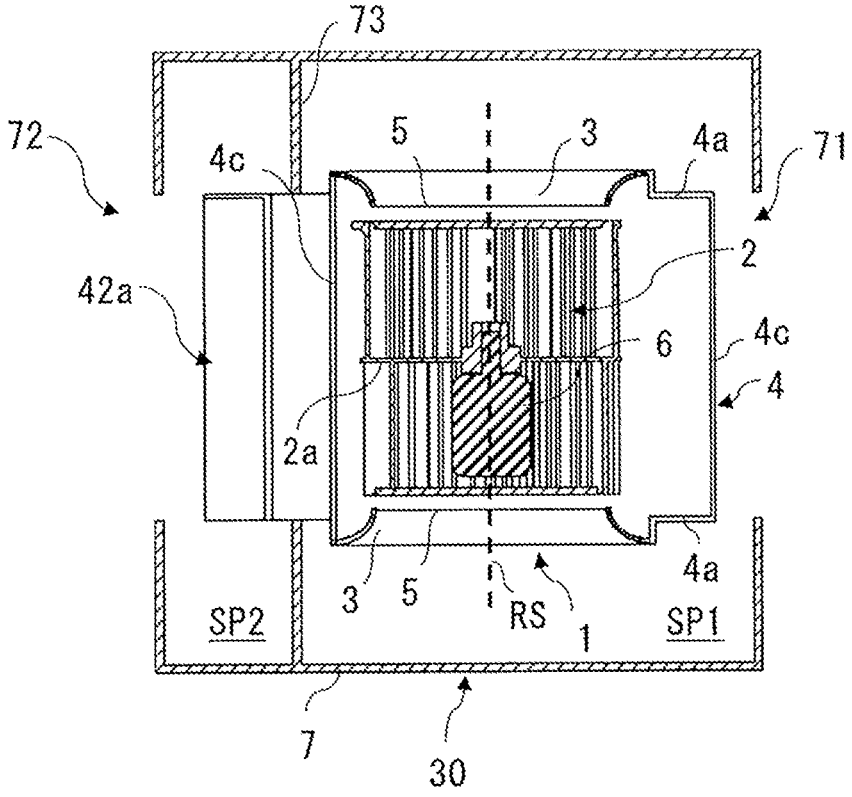
FIG. 19 illustrates a configuration of an air-sending device according to Embodiment 4 of the present disclosure.

FIG. 19 illustrates a configuration of the air-sending device 30 according to Embodiment 4 of the present disclosure. Parts having the same configurations as those of the centrifugal fan 1 and the other centrifugal fans in FIGS. 1 to 10 are denoted by the same reference numerals, and a description thereof will be omitted. The air-sending device 30 according to Embodiment 4 is a ventilating fan or a desk fan, for example. The air-sending device 30 includes the centrifugal fan 1 according to Embodiment 1 or the centrifugal fan 1D according to Embodiment 2, and a case 7 accommodating the centrifugal fan 1 or 1D. The case 7 has two openings, namely, an air inlet 71 and an air outlet 72. As illustrated in FIG. 19, the air-sending device 30 is configured such that the air inlet 71 and the air outlet 72 are formed in positions facing each other. Note that in the air-sending device 30, the air inlet 71 and the air outlet 72 do not have to be formed in positions facing each other. For example, either one of the air inlet 71 and the air outlet 72 may be formed on the top or the bottom of the centrifugal fan 1. In the case 7, a space SP1 including the portion where the air inlet 71 is formed and a space SP2 including the portion where the air outlet 72 is formed are separated by a partition plate 73. The centrifugal fan 1 is installed in a manner such that the air inlet 5 is located in the space SP1 where the air inlet 71 is formed and the air outlet 42*a* is located in the space SP2 where the air outlet 72 is formed.

In the air-sending device 30, when the fan 2 is driven and rotated by the motor 6, air is suctioned into the case 7 through the air inlet 71. The air suctioned into the case 7 is guided by the bell mouth 3 and suctioned into the fan 2. The air suctioned by the fan 2 is blown out to the radially outer side of the fan 2. The air blown out from the fan 2 passes through the inside of the scroll casing 4. Then, the air is blown out from the air outlet 42*a* of the scroll casing 4, and is blown out from the air outlet 72 of the case 7.

Since the air-sending device 30 according to Embodiment 4 includes the centrifugal fan 1 according to Embodiment 1 or the centrifugal fan 1D according to Embodiment 2, it is possible to efficiently increase the pressure in the scroll portion 41. Further, the air-sending device 30 can achieve a reduction in noise level.

Embodiment 5

Figure 20:
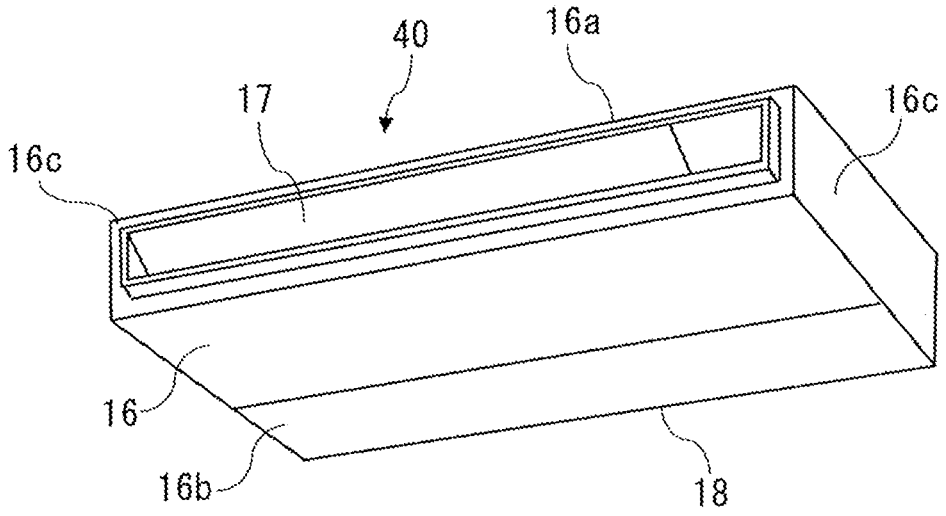
FIG. 20 is a perspective view of an air-conditioning apparatus according to Embodiment 5 of the present disclosure.
Figure 21:
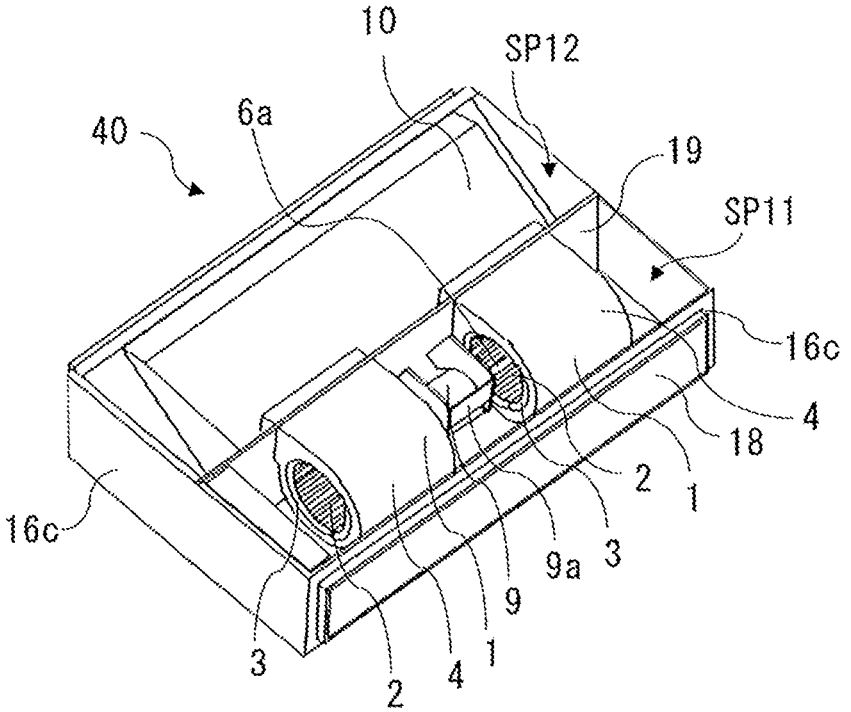
FIG. 21 illustrates an inner configuration of the air-conditioning apparatus according to Embodiment 5 of the present disclosure.
Figure 22:
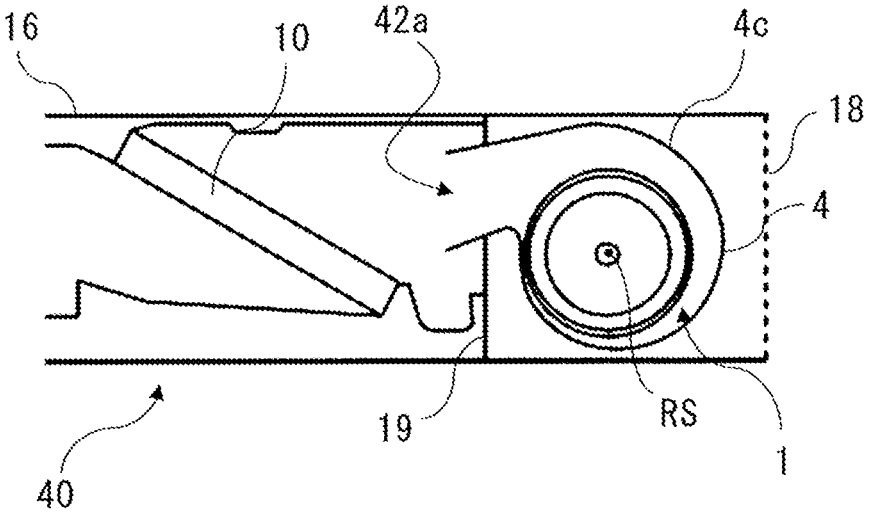
FIG. 22 is a cross-sectional view of the air-conditioning apparatus according to Embodiment 5 of the present disclosure.
Figure 23:
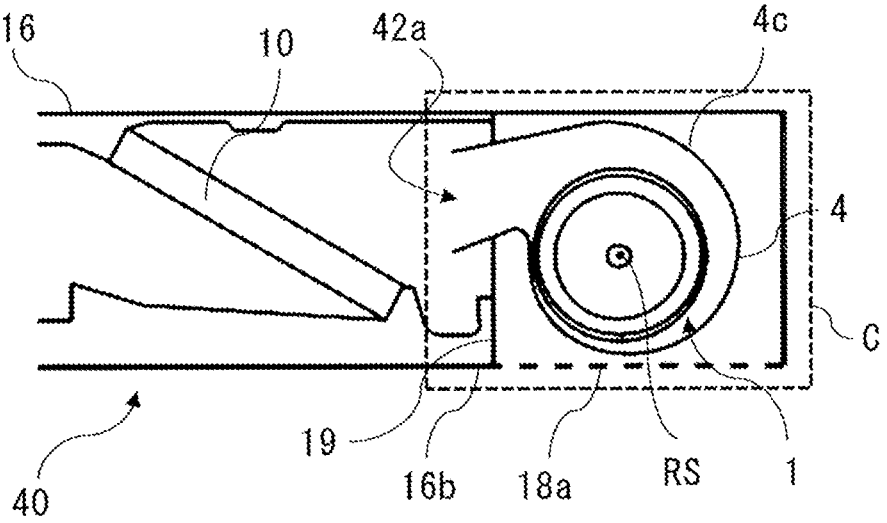
FIG. 23 is a cross-sectional view of a modified example of the air-conditioning apparatus according to Embodiment 5 of the present disclosure.

FIG. 20 is a perspective view of the air-conditioning apparatus 40 according to Embodiment 5 of the present disclosure. FIG. 21 illustrates an inner configuration of the air-conditioning apparatus 40 according to Embodiment 5 of the present disclosure. FIG. 22 is a cross-sectional view of the air-conditioning apparatus 40 according to Embodiment 5 of the present disclosure. FIG. 23 is a cross-sectional view of a modified example of the air-conditioning apparatus 40 according to Embodiment 5 of the present disclosure. Note that parts having the same configurations as those of the centrifugal fan 1 and the other centrifugal fans in FIGS. 1 to 10 are denoted by the same reference numerals, and a description thereof will be omitted. In FIG. 21, an upper surface portion 16*a* is omitted to illustrate the inner configuration of the air-conditioning apparatus 40. The air-conditioning apparatus 40 according to Embodiment 5 includes at least one of the centrifugal fan 1 according to Embodiment 1 and the centrifugal fan 1D according to Embodiment 2, and a heat exchanger 10 disposed in a position facing the air outlet 42*a* of the at least one of the centrifugal fans 1 and 1D. The air-conditioning apparatus 40 according to Embodiment 5 includes a case 16 installed above a ceiling of an air-conditioned room. In the following description, the centrifugal fan 1 is either one of the centrifugal fan 1 according to Embodiment 1 and the centrifugal fan 1D according to Embodiment 2.

As illustrated in FIG. 20, the case 16 is formed in the shape of a rectangular parallelepiped, including the upper surface portion 16*a*, a lower surface portion 16*b*, and side surface portions 16*c*. Note that the shape of the case 16 is not limited to a rectangular parallelepiped, and may be another shape such as a cylindrical shape, the shape of a prism, a conical shape, a shape having a plurality of corners, or a shape having a plurality of curved surfaces. The case 16 includes, among the side surface portions 16*c*, the side surface portion 16*c* having a case air outlet 17. As illustrated in FIG. 20, the case air outlet 17 is formed in a rectangular shape. Note that the shape of the case air outlet 17 is not limited to a rectangular shape. For example, the shape of the case air outlet 17 may be a circular shape or an oval shape, or may be another shape. The case 16 includes, among the side surface portions 16*c*, the side surface portion 16*c* having a case air inlet 18 on the side opposite to the side with the case air outlet 17. As illustrated in FIG. 21, the case air inlet 18 is formed in a rectangular shape. Note that the shape of the case air inlet 18 is not limited to a rectangular shape. For example, the shape of the case air inlet 18 may a circular shape or an oval shape, or may be another shape. A filter for removing dust in the air may be disposed at the case air inlet 18.

The case 16 accommodates therein two centrifugal fans 1, a fan motor 9, and the heat exchanger 10. Each of the centrifugal fans 1 includes the fan 2, and the scroll casing 4 having the bell mouth 3. The fan motor 9 is supported by a motor support 9*a* fixed to the upper surface portion 16*a* of the case 16. The fan motor 9 includes an output shaft 6*a*. The output shaft 6*a* is disposed to extend in a direction parallel to the side surface portion 16*c* having the case air inlet 18 and the side surface portion 16*c* having the case air outlet 17. As illustrated in FIG. 21, in the air-conditioning apparatus 40, two fans 2 are attached to the output shaft 6*a*. The fans 2 generate the flow of air that is suctioned into the case 16 from the case air inlet 18 and blown out from the case air outlet 17 into the air-conditioned space. Note that the number of centrifugal fans 1 disposed in the case 16 is not limited to two and may be one or three or more.

As illustrated in FIG. 21, each centrifugal fan 1 is mounted on a partition plate 19. The inner space of the case 16 is divided into a space SP11 on the inlet side of the scroll casing 4 and a space SP12 on the outlet side of the scroll casing 4 by the partition plate 19.

As illustrated in FIG. 22, the heat exchanger 10 is disposed in a position facing the air outlet 42*a* of each centrifugal fan 1, and is disposed on the flow passage of the air discharged from the centrifugal fan 1 in the case 16. The heat exchanger 10 adjusts the temperature of the air that is suctioned into the case 16 from the case air inlet 18 and blown out from the case air outlet 17 into the air-conditioned space. Note that the heat exchanger 10 used herein may be one having a well-known structure. The case air inlet 18 only needs to be formed in a position perpendicular to the axial direction of the rotation shaft RS of the centrifugal fan 1. For example, as illustrated in FIG. 23, the case air inlet 18 may be formed in the lower surface portion 16*b*.

Figure 24:
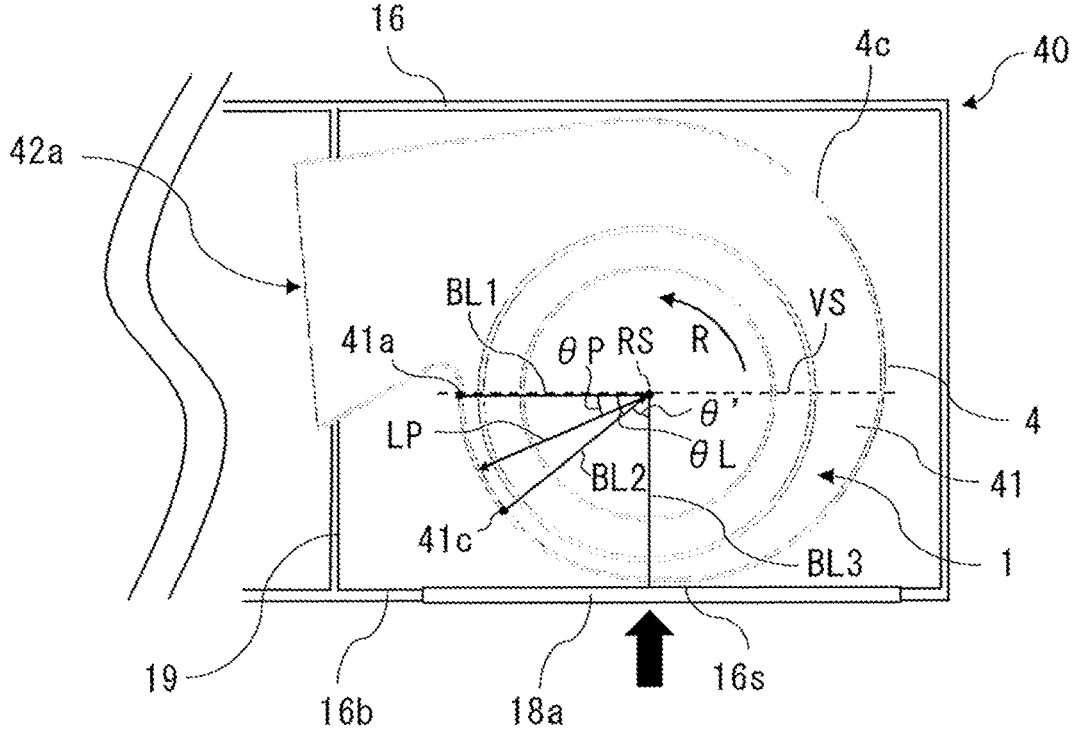
FIG. 24 is a partially enlarged view of a part C of the modified example of the air-conditioning apparatus of FIG. 23.
Figure 25:
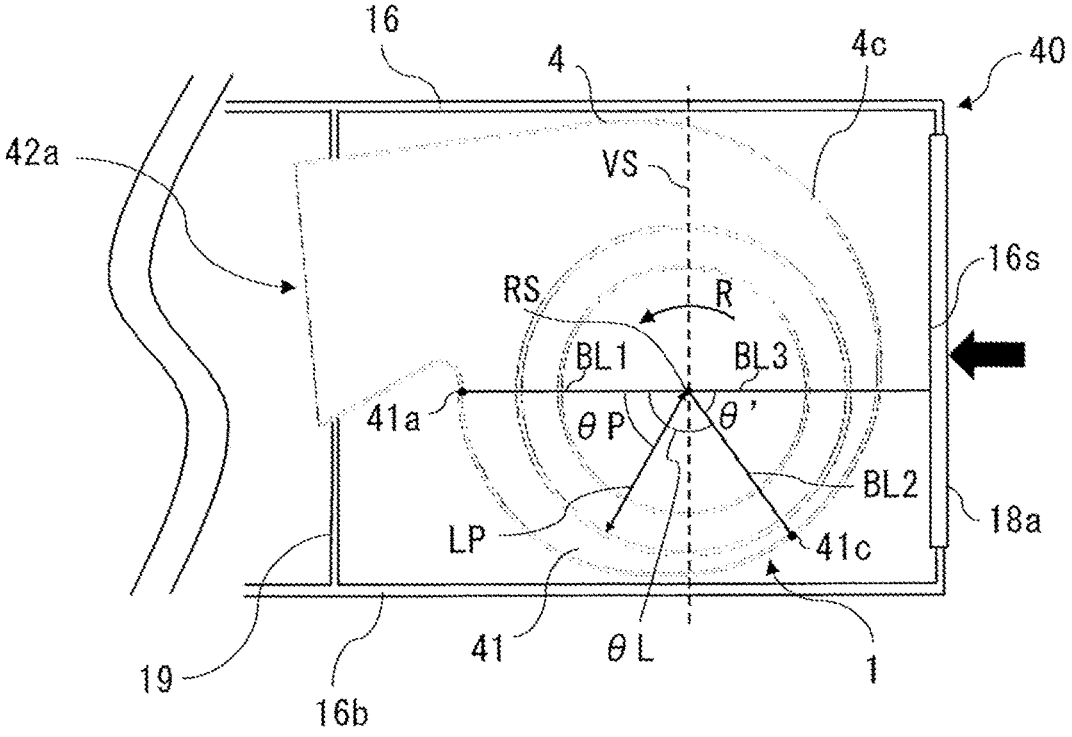
FIG. 25 is a partially enlarged view of a part C of another modified example of the air-conditioning apparatus of FIG. 23.

FIG. 24 is a partially enlarged view of a part C of the modified example of the air-conditioning apparatus 40 of FIG. 23. FIG. 25 is a partially enlarged view of a part C of another modified example of the air-conditioning apparatus 40 of FIG. 23. The arrows illustrated in FIGS. 24 and 25 indicate the flow of gas to be suctioned into the case 16. The centrifugal fan 1 is formed such that the closest portion 41*c* is disposed between a case wall portion 16S having a case air inlet 18*a* and a virtual plane portion VS passing through the rotation shaft RS of the fan 2 and parallel to the case wall portion 16S. More specifically, when a line extending from the rotation shaft RS of the fan 2 and perpendicular to the case wall portion 16S having the case air inlet 18*a* is defined as a third reference line BL3, the centrifugal fan 1 is configured such that the closest portion 41*c* is shifted from the third reference line BL3 toward the inner end 41*a* by an angle θ'. That is, the closest portion 41*c* is disposed between the third reference line BL3 and the inner end 41*a*.

As illustrated in FIG. 24, in the case of the modified example of the air-conditioning apparatus 40, the angle between the first reference line BL1 and the third reference line BL3 is about 90 degrees in the rotation direction R. However, the position of the third reference line BL3 is not limited to the position where the angle between the first reference line BL1 and the third reference line BL3 is about 90 degrees. For example, as in the modified example of the air-conditioning apparatus 40 illustrated in FIG. 25, the angle between the first reference line BL1 and the third reference line BL3 may be about 180 degrees in the rotation direction R. The centrifugal fan 1 is formed such that the closest portion 41*c* is disposed between the case wall portion 16S having a case air inlet 18 and a virtual plane portion VS passing through the rotation shaft RS of the fan 2 and parallel to the case wall portion 16S. That is, the third reference line BL3 only needs to be a line extending from the rotation shaft RS of the fan 2 and perpendicular to the case wall portion 16S having a case air inlet, in a cross-section perpendicular to the rotation shaft RS.

When the fan 2 is driven and rotated by the motor 6, air in the air-conditioned space is suctioned into the case 16 through the case air inlet 18 or the case air inlet 18*a*. The air suctioned into the case 16 is guided by the bell mouth 3 and suctioned into the fan 2. The air suctioned into the fan 2 is blown out to the radially outer side of the fan 2. The air blown out from the fan 2 passes through the inside of the scroll casing 4. Then, the air is blown out from the air outlet 42*a* of the scroll casing 4, and is supplied to the heat exchanger 10. When the air supplied to the heat exchanger 10 passes through the heat exchanger 10, the heat thereof is exchanged, so that the temperature and humidity thereof are adjusted. The air having passed through the heat exchanger 10 is blown out from the case air outlet 17 into the air-conditioned space.

Since the air-conditioning apparatus 40 according to Embodiment 5 includes the centrifugal fan 1 according to Embodiment 1 or the centrifugal fan 1D according to Embodiment 2, it is possible to efficiently increase the pressure in the scroll portion 41. Further, the air-sending device 30 can achieve a reduction in noise level.

The centrifugal fan 1 housed in the air-conditioning apparatus 40 is configured such that the closest portion 41*c* is shifted from the third reference line BL3 toward the inner end 41*a* by the angle θ'. Therefore, the centrifugal fan 1 housed in the air-conditioning apparatus 40 can increase the suction air volume and the distance for increasing the pressure in the scroll portion 41.

Embodiment 6

Figure 26:
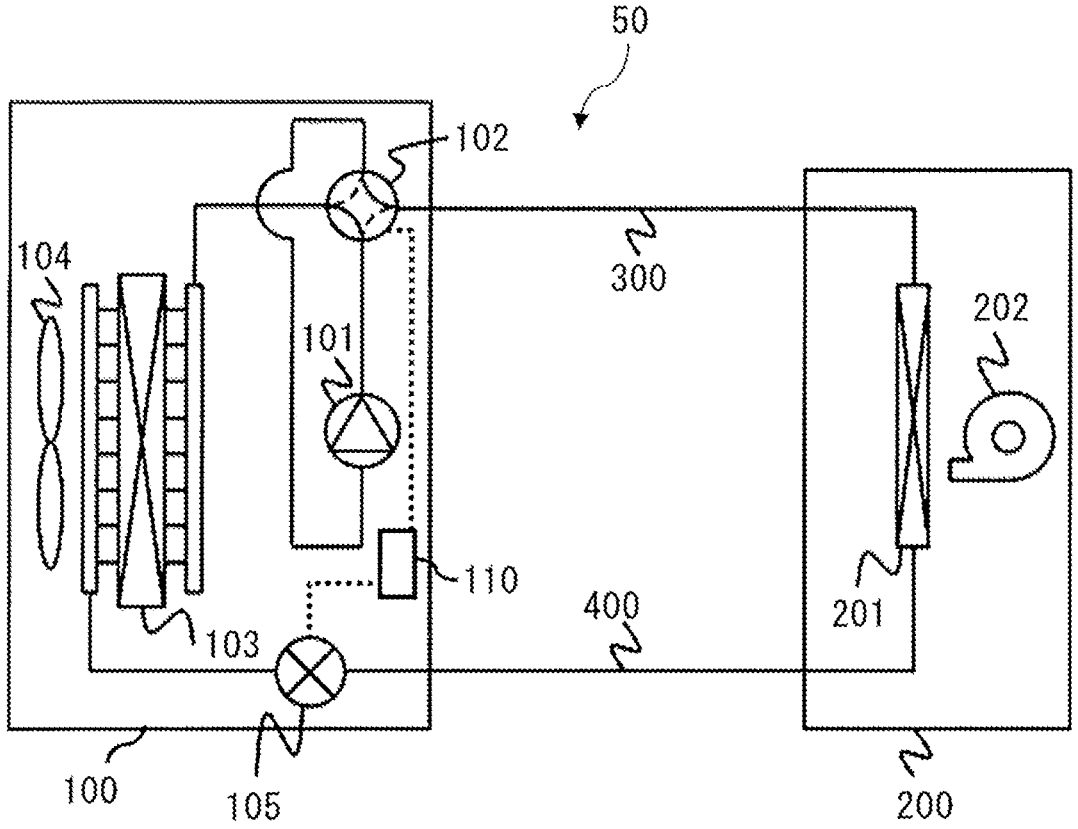
FIG. 26 illustrates a configuration of a refrigeration cycle apparatus according to Embodiment 6 of the present disclosure.

FIG. 26 illustrates a configuration of the refrigeration cycle apparatus 50 according to Embodiment 6 of the present disclosure. Note that the centrifugal fan 1 according to Embodiment 1 or the centrifugal fan 1D according to Embodiment 2 is used in an indoor unit 200 of the refrigeration cycle apparatus 50 according to Embodiment 6. Further, in the following description, the refrigeration cycle apparatus 50 is used for conditioning air. However, the refrigeration cycle apparatus 50 is not limited to those used for air-conditioning purposes. The refrigeration cycle apparatus 50 is used for refrigeration purposes or air-conditioning purposes, and applicable to apparatuses such as a refrigerator or a freezer, a vending machine, an air-conditioning apparatus, a refrigeration apparatus, and a water heater.

The refrigeration cycle apparatus 50 according to Embodiment 6 performs air conditioning, by heating or cooling the room through transfer of heat between the outside air and the indoor air via refrigerant. The refrigeration cycle apparatus 50 according to Embodiment 6 includes an outdoor unit 100 and the indoor unit 200. In the refrigeration cycle apparatus 50, the outdoor unit 100 and the indoor unit 200 are connected via refrigerant pipes 300 and 400 to form a refrigerant circuit in which refrigerant circulates. The refrigerant pipe 300 is a gas pipe through which refrigerant in a gas phase flows, and the refrigerant pipe 400 is a liquid pipe through which refrigerant in a liquid phase flows. Note that two-phase gas-liquid refrigerant may flow through the refrigerant pipe 400. In the refrigerant circuit of the refrigeration cycle apparatus 50, a compressor 101, a flow switching device 102, an outdoor heat exchanger 103, an expansion valve 105, and an indoor heat exchanger 201 are sequentially connected via the refrigerant pipes.

The outdoor unit 100 includes the compressor 101, the flow switching device 102, the outdoor heat exchanger 103, and the expansion valve 105. The compressor 101 compresses and discharges the suctioned refrigerant. The compressor 101 may include an inverter device, and may be configured such that the inverter device changes the operating frequency to change the capacity of the compressor 101. Note that the capacity of the compressor 101 is the amount of refrigerant discharged therefrom per unit time. The flow switching device 102 is, for example, a four-way valve, and is configured to switch the direction of the refrigerant flow passage. The refrigeration cycle apparatus 50 switches the flow of refrigerant with use of the flow switching device 102 based on an instruction from a controller 110, thereby performing a heating operation or a cooling operation.

The outdoor heat exchanger 103 exchanges heat between the refrigerant and the outdoor air. During a heating operation, the outdoor heat exchanger 103 serves as an evaporator to exchange heat between the low-pressure refrigerant having entered from the refrigerant pipe 400 and the outdoor air, and evaporate and gasify the refrigerant. During a cooling operation, the outdoor heat exchanger 103 serves as a condenser to exchange heat between the refrigerant compressed by the compressor 101 and having entered from the flow switching device 102 side and the outdoor air to condense and liquefy the refrigerant. The outdoor heat exchanger 103 is provided with an outdoor fan 104 to increase the heat exchange efficiency between the refrigerant and the outdoor air. An inverter device may be attached to the outdoor fan 104 to change the operating frequency of a fan motor and thereby change the rotation speed of the fan. The expansion valve 105 is an expansion device (flow rate control means) that serves as an expansion valve by adjusting the flow rate of the refrigerant flowing through the expansion valve 105. The expansion valve 105 adjusts the pressure of the refrigerant by changing the opening degree. For example, if the expansion valve 105 is an electronic expansion valve, the opening degree is adjusted based on an instruction from the controller 110 or other units.

The indoor unit 200 includes the indoor heat exchanger 201 configured to exchange heat between the refrigerant and the indoor air, and an indoor fan 202 configured to adjust the flow of air with which the indoor heat exchanger 201 performs heat exchange. During a heating operation, the indoor heat exchanger 201 serves as a condenser to exchange heat between the refrigerant having entered from the refrigerant pipe 300 and the indoor air, condense and liquefy the refrigerant, and discharge the refrigerant toward the refrigerant pipe 400. During a cooling operation, the indoor heat exchanger 201 serves as an evaporator to exchange heat between the refrigerant decompressed by the expansion valve 105 and the indoor air, evaporate and gasify the refrigerant through removal of heat from the air, and discharge the refrigerant toward the refrigerant pipe 300. The indoor fan 202 is disposed to face the indoor heat exchanger 201. The indoor fan 202 may be any one or more of the centrifugal fan 1 according to Embodiment 1 and the centrifugal fan 1D according to Embodiment 2. The operation speed of the indoor fan 202 is specified by the user's setting. An inverter device may be attached to the indoor fan 202 to change the operating frequency of a fan motor (not illustrated) and thereby change the rotation speed of the fan 2.

The following describes a cooling operation as an example operation of the refrigeration cycle apparatus 50. High-temperature high-pressure gas refrigerant compressed and discharged by the compressor 101 flows into the outdoor heat exchanger 103 via the flow switching device 102. The gas refrigerant that has flowed into the outdoor heat exchanger 103 is condensed through heat exchange with the outside air sent by the outdoor fan 104 to become low-temperature refrigerant. Then, the refrigerant is discharged from the outdoor heat exchanger 103. The refrigerant discharged from the outdoor heat exchanger 103 is expanded and decompressed by the expansion valve 105 to become low-temperature low-pressure two-phase gas-liquid refrigerant. The two-phase gas-liquid refrigerant flows into the indoor heat exchanger 201 of the indoor unit 200, and evaporates through heat exchange with the indoor air sent by the indoor fan 202 to become low-temperature low-pressure gas refrigerant. Then, the refrigerant is discharged from the indoor heat exchanger 201. The indoor air cooled through heat removal by the refrigerant is blown out as conditioned air from the air outlet of the indoor unit 200 into the air-conditioned space. The gas refrigerant discharged from the indoor heat exchanger 201 is suctioned into the compressor 101 via the flow switching device 102, and compressed again. The operation above is repeated.

The following describes a heating operation as an example operation of the refrigeration cycle apparatus 50. High-temperature high-pressure gas refrigerant compressed and discharged by the compressor 101 flows into the indoor heat exchanger 201 of the indoor unit 200 via the flow switching device 102. The gas refrigerant that has flowed into the indoor heat exchanger 201 is condensed through heat exchange with the indoor air sent by the indoor fan 202 to become low-temperature refrigerant. Then, the refrigerant is discharged from the indoor heat exchanger 201. The indoor air heated by receiving heat from the gas refrigerant is blown out as conditioned air from the air outlet of the indoor unit 200 into the air-conditioned space. The refrigerant discharged from the indoor heat exchanger 201 is expanded and decompressed by the expansion valve 105 to become low-temperature low-pressure two-phase gas-liquid refrigerant. The two-phase gas-liquid refrigerant flows into the outdoor heat exchanger 103 of the outdoor unit 100, and evaporates through heat exchange with the outside air sent by the outdoor fan 104 to become low-temperature low-pressure gas refrigerant. Then, the refrigerant is discharged from the outdoor heat exchanger 103. The gas refrigerant discharged from the outdoor heat exchanger 103 is suctioned into the compressor 101 via the flow switching device 102, and compressed again. The operation above is repeated.

Since the refrigeration cycle apparatus 50 according to Embodiment 6 includes the centrifugal fan 1 according to Embodiment 1 or the centrifugal fan 1D according to Embodiment 2, it is possible to efficiently increase the pressure in the scroll portion 41. Further, the air-sending device 30 can achieve a reduction in noise level.

The configurations described in the above embodiments illustrate an example of the details of the present disclosure, and can be combined with other well-known techniques. Further, a part of the configuration can be omitted or modified without departing from the spirit of the present disclosure.

The invention claimed is:

1. A centrifugal fan comprising:
a fan configured to be driven to rotate; and
a scroll casing housing the fan;
the scroll casing including
a peripheral wall having a volute shape having an inner end of a spiral thereof at a boundary with a tongue portion of the scroll casing, the tongue portion being configured to guide airflow generated by the fan,
the peripheral wall including, when a portion at the peripheral wall at which a distance between the peripheral wall and a rotation shaft of the fan is minimum is defined as a closest portion,
a narrowed portion at which the distance between the peripheral wall and the rotation shaft is reduced from the inner end toward the closest portion in a rotation direction of the fan, and
an expanded portion that is formed between the narrowed portion and the closest portion and at which the distance between the peripheral wall and the rotation shaft is increased or the distance between the peripheral wall and the rotation shaft is constant.

2. The centrifugal fan of claim 1,
wherein the scroll casing is configured such that, in a region from the inner end to the closest portion,
a flow passage for gas formed between the peripheral wall and an outer peripheral portion of the fan is gradually narrowed at the narrowed portion, and
the flow passage is then widened at the expanded portion.

3. The centrifugal fan of claim 1, wherein compared to a virtual reference peripheral wall configured such that the peripheral wall approaches the rotation shaft at a constant rate from the inner end toward the closest portion, the expanded portion expands in a radial direction of the fan.

4. The centrifugal fan of claim 1,
wherein the peripheral wall includes, between the inner end and the closest portion,
a first inflection portion defining a boundary portion between a part where the peripheral wall approaches the rotation shaft and a part where the peripheral wall separates from the rotation shaft, and
a second inflection portion defining a boundary portion between the part where the peripheral wall separates from the rotation shaft and a part where the peripheral wall approaches the rotation shaft; and
wherein the second inflection portion is located at the expanded portion.

5. The centrifugal fan of claim 4, wherein the peripheral wall is configured to gradually separate from the rotation shaft, from the first inflection portion to the second inflection portion.

6. The centrifugal fan of claim 1, wherein the peripheral wall includes a constant distance portion formed between the narrowed portion and the closest portion and at which the distance between the peripheral wall and the rotation shaft is constant.

7. The centrifugal fan of claim 6,
wherein the peripheral wall includes, in a region from the inner end to the closest portion,
a first inflection portion defining a boundary portion between a part where the peripheral wall approaches an outer peripheral portion of the fan and a part where a distance between the peripheral wall and the outer peripheral portion of the fan is constant, and
a second inflection portion defining a boundary portion between the part where the distance between the peripheral wall and the outer peripheral portion of the fan is constant and a part where the peripheral wall approaches the outer peripheral portion of the fan;

wherein the second inflection portion is located at the expanded portion; and wherein the constant distance portion is formed between the first inflection portion and the second inflection portion.

8. The centrifugal fan of claim 1, wherein the distance between the peripheral wall and the rotation shaft at the expanded portion is less than the distance between the peripheral wall and the rotation shaft at the inner end.

9. The centrifugal fan of claim 1, wherein the peripheral wall includes a protrusion protruding from an inner wall of the closest portion toward an inner side of the scroll casing.

10. The centrifugal fan of claim 9, wherein the protrusion is formed across the peripheral wall in a rotation axis direction of the fan.

11. The centrifugal fan of claim 9, wherein the protrusion is formed at part of the peripheral wall in a rotation axis direction of the fan.

12. The centrifugal fan of claim 9, wherein the protrusion is provided in plurality in a rotation axis direction of the fan.

13. The centrifugal fan of claim 9, wherein the protrusion is formed to have a thickness that is uniform in a rotation axis direction of the fan.

14. The centrifugal fan of claim 9, wherein the protrusion is formed to have a thickness that varies by location in a rotation axis direction of the fan.

15. An air-sending device comprising:

the centrifugal fan of claim 1, and a case housing the centrifugal fan.

16. An air-conditioning apparatus comprising:

the centrifugal fan of claim 1, and a heat exchanger disposed in a position facing an air outlet of the centrifugal fan.

17. The air-conditioning apparatus of claim 16, further comprising:

a case housing the centrifugal fan and the heat exchanger, the case includes a case wall portion having a case air inlet through which gas that enters the centrifugal fan passes;

wherein the closest portion is disposed between the case wall portion and a virtual plane portion passing through the rotation shaft and parallel to the case wall portion, in a cross-section perpendicular to the rotation shaft.

18. The air-conditioning apparatus of claim 16, further comprising:

a case housing the centrifugal fan and the heat exchanger, the case includes a case wall portion having a case air inlet through which gas that enters the centrifugal fan passes;

wherein when a line extending from the rotation shaft and perpendicular to the case wall portion is defined as a reference line, the closest portion is disposed between the reference line and the inner end, in a cross-section perpendicular to the rotation shaft.

19. A refrigeration cycle apparatus comprising:

the centrifugal fan of claim 1.

* * * * *